United States Patent [19]

Takagi et al.

[11] Patent Number: 4,851,321

[45] Date of Patent: Jul. 25, 1989

[54] SUPERHIGH CONTRAST NEGATIVE-TYPE SILVER HALIDE PHOTOGRAPHIC MATERIAL

[75] Inventors: Yoshihiro Takagi; Hisashi Okada; Morio Yagihara; Kazunobu Katoh, all of Kanagawa, Japan

[73] Assignee: Fuji Photo Film Co., Ltd., Kanagawa, Japan

[21] Appl. No.: 117,724

[22] Filed: Nov. 6, 1987

[30] Foreign Application Priority Data

Nov. 14, 1986 [JP] Japan ..... 61-271113

[51] Int. Cl.[4] ..... G03C 5/24; G03C 1/06

[52] U.S. Cl. ..... 430/264; 430/267; 430/268; 430/449; 430/949

[58] Field of Search ..... 430/264, 949, 267, 268

[56] References Cited

U.S. PATENT DOCUMENTS

| | | | |
|---|---|---|---|
| 3,910,795 | 10/1975 | Shiba et al. | 430/591 |
| 4,447,522 | 5/1984 | Hirano et al. | 430/264 |
| 4,681,836 | 7/1987 | Inoue et al. | 430/949 |
| 4,762,769 | 8/1988 | Takahashi et al. | 430/949 |

*Primary Examiner*—Mukund J. Shah, PhD

*Attorney, Agent, or Firm*—Sughrue, Mion, Zinn, Macpeak & Seas

[57] ABSTRACT

A superhigh contrast negative type silver halide photographic material comprising a support having provided thereon at least one silver halide emulsion layer, the emulsion layer or at least one other hydrophilic colloid layer containing at least one hydrazine derivative and at least one compound of formula (I):

$$Y\text{-}[(X)_n A - B]_m \quad (I)$$

wherein Y represents a group capable of adsorbing to silver halide; X represents a divalent linking group comprising an atom or atoms selected from a hydrogen atom, a carbon atom, a nitrogen atom, an oxygen atom and a sulfur atom or an atomic group comprised of the atoms; A represents a divalent linking group; B represents a substituted or unsubstituted amino group, an ammonium group or a nitrogen-containing heterocyclic group; m represents 1, 2 or 3; and n represents 0 or 1. The photographic material may contain an organic desensitizer and a water-soluble rhodium salt, and the material has a low sensitivity and can be handled in a bright room.

8 Claims, No Drawings

SUPERHIGH CONTRAST NEGATIVE-TYPE SILVER HALIDE PHOTOGRAPHIC MATERIAL

FIELD OF THE INVENTION

The present invention relates to a silver halide photographic material and a method for forming a superhigh contrast negative image using the same and, in particular, to a silver halide photographic material to be used in a photomechanical process, specifically, a superhigh contrast negative-type silver halide photographic material which is suitable as a silver halide photographic material which can be handled in a bright room (hereinafter referred to as "a bright room-type silver halide photographic material").

BACKGROUND OF THE INVENTION

In the field of graphic arts, an image formation system capable of giving a photographic characteristic of superhigh contrast (especially having a gamma value of 10 or more) is required, so as to attain a good reproduction of a dot image of continuous gradation as well as a good reproduction of a line image.

A specific developer called a lith developer has heretofore been used for such a purpose. The lith developer contains only hydroquinone as a developing agent, and uses a sulfite preservative in the form of an adduct of a sulfite with formaldehyde in order to preserve the infectious developability of the lith developer. The concentration of the free sulfite ion in the developer is kept extremely low (usually 0.1 mol/liter or less). Such a lith developer is extremely easily oxidized with air and cannot last for more than 3 days, which is a serious defect.

Methods for obtaining a photographic characteristic of high contrast by the use of a stable developer are disclosed in U.S. Pat. Nos. 4,224,401, 4,168,977, 4,166,742, 4,311,781, 4,272,606, 4,211,857, 4,243,739, etc., where a hydrazine derivative is used. According to the methods, a photographic characteristic of superhigh contrast and high sensitivity may be obtained and, moreover, addition of a sulfite of high concentration to a developer is possible. Accordingly, the stability of the developer against air oxidation is remarkably improved, as opposed to the lith developer. In the methods using a hydrazine compound for forming a superhigh contrast image, however, there are various problems including the variation of the pH value of the processing solution due to processing fatigue or aerial fatigue, the lowering of the concentration of the processing solution due to the depletion of the developing agent or accumulation of an inhibitor, each of which results in lowering of the contrast of the gradation.

Accordingly, means for intensifying the effect of the hydrazine compounds to elevate the contrast of photographic materials are being strongly sought after, and Japanese patent application (OPI) No. 167939/86 (the term "OPI" as used herein refers to a "published unexamined Japanese patent application ") illustrates the use of a phosphonium salt compound, Japanese patent application (OPI) No. 198147/86 illustrates the use of a disulfide compound, and Japanese patent application (OPI) No. 140340/85 illustrates the use of an amine series compound, as a contrast-intensifying agent. Even by the use of these compounds, however, it was still impossible to prevent the eventual lowering of the contrast of photographic materials during the processing thereof.

On the other hand, regarding a bright room-type photographic material with a low sensitivity which contains a hydrazine compound, there is, for example, a silver halide photographic material containing a water-soluble rhodium salt in Japanese patent application (OPI) Nos. 83038/85 and 162246/85. In the material, however, the addition of a rhodium in a sufficient amount so as to lower the sensitivity injures the intensification of the contrast by the action of the hydrazine compound, whereby the desired sufficient high contrast image could not be obtained.

In addition, Japanese patent application (OPI) No. 157633/84 illustrates a method for preparation of a silver halide photographic emulsion which contains a water-soluble rhodium salt in an amount of from $10^{-8}$ to $10^{-5}$ mol per mol of the silver halide and an organic desensitizer where the sum of the cathodic potential and the anodic potential in polarography is positive. However, although the sensitivity may surely be lowered by the method, it is impossible to obtain a sufficient high contrast image which can be utilized in the industrial field of the present invention by the method. Needless to say, Japanese patent application (OPI) No. 157633/84 does not suggest the use of any hydrazine compound.

Hitherto, in a high contrast silver halide photographic material containing a hydrazine compound, the incorporation of an organic desensitizer so as to lower the sensitivity was technically extremely difficult. This is believed to be so because the hydrazine compound has a fundamental function of participating in the development procedure so as to cause the nucleating infectious development because of the electron-donating property thereof to silver halides thereby to give a high contrast image, while the organic desensitizer is a photoelectron acceptor to accept photoelectrons during the image exposure and has a function to lower the sensitivity by interfering with the latent image formation and, on the other hand, the desensitizer also accepts electrons donated from the electron donor such as the hydrazine compound during the development procedure so as to interfere with the nucleating infectious development and further to inhibit the formation of a high contrast image.

Japanese patent application (OPI) No. 62245/81 illustrates a method of forming a high contrast image where a photographic material is developed in the presence of a tetrazolium compound so that the development in the tow part of the characteristic curve is inhibited by the tetrazolium compound. However, this method also has various problems in that the tetrazolium compound-containing silver halide photographic material deteriorates during storage whereupon only a low contrast image can be obtained, that the reaction product from the tetrazolium compound formed by development processing partly remains in the film processed to cause a stain on the film, and that the film often has unevenness of development.

As mentioned above, the conventional method of forming a high contrast image by the use of hydrazine compound is always accompanied by the problems that low contrast images are often obtained in the step of running, i.e., continuous, processing or, when a rhodium salt or an organic desensitizer is added so as to lower the sensitivity of the image, low contrast images are always obtained. In other words, it was extremely difficult to lower the sensitivity of the superhigh contrast image obtained by the use of a hydrazine compound while maintaining the high contrast thereof.

In addition, the hydrazine compound is often added in a large amount so as to intensify the high contrast whereby the strength of the emulsion film is weakened, the storage stability is deteriorated or the excess amount of the hydrazine compound used often dissolves out into the developer during running processing, and thus, the use of such large amount of the hydrazine compound often has a bad influence on the photographic materials to be processed. Accordingly, it is also desired to positively elevate the contrast of photographic materials while using only a small amount of hydrazine compounds.

SUMMARY OF THE INVENTION

One object of the present invention is to provide a means for enhancing the high contrast of a hydrazine compound-containing type photographic material.

Another object of the present invention is to provide a means for enhancing the high contrast of a type of a photographic material containing a rhodium salt or an organic desensitizer.

Still another object of the present invention is to provide a bright room-type photographic material with a low sensitivity.

The above-mentioned objects of the present invention can be achieved by a superhigh contrast negative type silver halide photographic material which comprises a support having provided thereon at least one silver halide emulsion layer, the emulsion layer or at least one other hydrophilic colloid layer containing at least one hydrazine derivative and at least one compound represented by formula (I):

$$Y[(X)_n A\text{-}B]_m \qquad (I)$$

wherein Y represents a group of adsorbing to silver halide; X represents a divalent linking group comprising an atom or atoms selected from a hydrogen atom, a carbon atom, a nitrogen atom, an oxygen atom and a sulfur atom, or an atomic group comprised of the atoms; A represents a divalent linking group; B represents a substituted or unsubstituted amino group, an ammonium group or a nitrogen-containing heterocyclic group; m represents 1, 2 or 3; and n represents 0 or 1. When m is more than 1, $[X_n A\text{-}B]$ may be the same or different.

DETAILED DESCRIPTION OF THE INVENTION

The group capable of adsorbing to silver halide, as represented by Y, includes a residue of a nitrogen-containing heterocyclic compound.

When Y represents a residue of a nitrogen-containing heterocyclic compound, the compound of formula (I) is represented by formula (II):

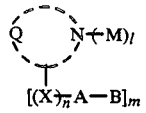

(II)

wherein l represents 0 or 1; X, A, B, m and n have the same meaning as those defined in the above-mentioned formula (I); Q represents an atomic group necessary for forming a 5- or 6-membered hetero ring which comprises at least one atom selected from a carbon atom, a nitrogen atom, an oxygen atom and a sulfur atom, and the hetero ring may optionally be condensed with a carbon-aromatic ring or a hetero-aromatic ring; and M represents a hydrogen atom, an alkali metal atom (such as a sodium atom, a potassium atom, etc.), an ammonium group (such as a trimethylammonium group, a dimethylbenzylammonium group, etc.), or a group capable of being converted into H or an alkali metal atom under an alkali condition (such as an acetyl group, a cyanoethyl group, a methanesulfonylethyl group, etc.).

The hetero ring formed by Q includes, for example, substituted or unsubstituted imidazoles, benzimidazoles, benzotriazoles, benzoxazoles, benzothiazoles, imidazoles, thiazoles, oxazoles, triazoles, tetrazoles, azaindenes, pyrazoles, indoles, triazines, pyrimidines, pyridines, quinolines, etc.

These hetero rings may optionally be substituted by one or more substituents selected from a nitro group, a halogen atom (e.g., a chlorine atom, a bromine atom, etc.), a mercapto group, a cyano group, a substituted or unsubstituted alkyl group (e.g., a methyl group, an ethyl group, a propyl group, a t-butyl group, a cyanoethyl group, a methoxyethyl group, a methylthioethyl group, etc.), a substituted or unsubstituted aryl group (e.g., a phenyl group, a 4-methanesulfonamidophenyl group, a 4-methylphenyl group, a 3,4-dichlorophenyl group, a naphthyl group, etc.), a substituted or unsubstituted alkenyl group (e.g., an allyl group, etc.), a substituted or unsubstituted aralkyl group (e.g., a benzyl group, a 4-methylbenzyl group, a phenethyl group, etc.), a substituted or unsubstituted alkoxy group (e.g., a methoxy group, an ethoxy group, etc.), a substituted or unsubstituted aryloxy group (e.g., a phenoxy group, a 4-methoxyphenoxy group, etc.), a substituted or unsubstituted alkylthio group (e.g., a methylthio group, an ethylthio group, a methoxyethylthio group, etc.), a substituted or unsubstituted arylthio group (e.g., a phenylthio group, etc.), a substituted or unsubstituted sulfonyl group (e.g., a methanesulfonyl group, an ethanesulfonyl group, a p-toluenesulfonyl group, etc.), a substituted or unsubstituted carbamoyl group (e.g., an unsubstituted carbamoyl group, a methylcarbamoyl group, a phenylcarbamoyl group, etc.), a substituted or unsubstituted sulfamoyl group (e.g., an unsubstituted sulfamoyl group, a methylsulfamoyl group, a phenylsulfamoyl group, etc.), a substituted or unsubstituted carbonamido group (e.g., an acetamido group, a benzamido group, etc.), a substituted or unsubstituted sulfonamido group (e.g., a methanesulfonamido group, a benzenesulfonamido group, a p-toluenesulfonamido group, etc.), a substituted or unsubstituted acyloxy group (e.g., an acetyloxy group, a benzoyloxy group, etc.), a substituted or unsubstituted sulfonyloxy group (e.g., a methanesulfonyloxy group, etc.), a substituted or unsubstituted ureido group (e.g., an unsubstituted ureido group, a methylureido group, an ethylureido group, a phenylureido group, etc.), a substituted or unsubstituted thioureido group (e.g., an unsubstituted thioureido group, a methylthioureido group, etc.), a substituted or unsubstituted acyl group (e.g., an acetyl group, a benzoyl group, etc.), a substituted or unsubstituted heterocyclic group (e.g., a 1-morpholino group, 1-piperazino group, a 2-pyridyl group, a 4-pyridyl group, a 2-thienyl group, a 1-pyrazolyl group, a 1-imidazolyl group, a 2-tetrahydrofuryl group, a tetrahydrothienyl group, etc.), a substituted or unsubstituted oxycarbonyl group (e.g., a methoxycarbonyl group, a phenoxycarbonyl group, etc.), a substituted or unsubstituted oxycarbonylamino group (e.g., a methoxycarbonylamino group, a phenoxycarbonylamino group, a 2-ethylhexyloxycarbonylamino group, etc.), a substituted or unsubstituted amino group (e.g., an unsubstituted amino group, a dimethylamino group, a methoxyethylamino group, an anilino group, etc.), a substituted or unsubstituted carboxylic acid or a salt thereof, a substituted or unsubstituted sulfonic acid or a salt thereof, a hydroxyl group, etc.

The divalent linking group represented by X includes, for example,

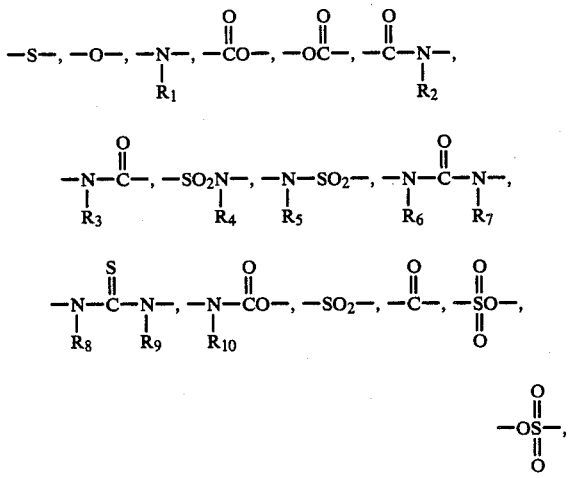

etc.; and the linking group may be bonded to Q optionally via a linear or branched alkylene group (such as a methylene group, an ethylene group, a propylene group, a butylene group, a hexylene group, a 1-methylethylene group, etc.). $R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group (e.g., a methyl group, an ethyl group, a propyl group, an n-butyl group, etc.), a substituted or unsubstituted aryl group (e.g., a phenyl group, a 2-methylphenyl group, etc.), a substituted or unsubstituted alkenyl group (e.g., a propenyl group, a 1-methylvinyl group, etc.), or a substituted or unsubstituted aralkyl group (e.g., a benzyl group, a phenethyl group, etc.).

A reprsents a divalent linking group, which includes, for example, a linear or branched alkylene group (e.g., a methylene group, an ethylene group, a propylene group, a butylene group, a hexylene group, a 1-methylethylene group, etc.), a linear or branched alkenylene group (e.g., a vinylene group, a 1-methylvinylene group, etc.), a linear or branched aralkylene group (e.g., a benzylidene group, etc.), an arylene group (e.g., a phenylene group, a naphthylene group, etc.), etc. The above-mentioned group represented by A may be further substituted, and X and A can be bonded to each other in any desired combination. Substituents for A may be selected from the group mentioned for the hetero ring of Y.

The substituted or unsubstituted amino group of B is represented by formula (VII):

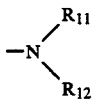

(VII)

wherein $R_{11}$ and $R_{12}$ may be the same or different and each represents a hydrogen atom or a substituted or unsubstituted alkyl, alkenyl or aralkyl group having from 1 to 30 carbon atoms, and the group may be linear (for example, a methyl group, an ethyl group, an n-propyl group, an n-butyl group, an n-octyl group, an allyl group, a 3-butenyl group, a benzyl group, a 1-naphthylmethyl group, etc.), or branched (for example, an isopropyl group, a t-octyl group, etc.), or cyclic (for example, a cyclohexyl group, etc.).

In addition, $R_{11}$ and $R_{12}$ may be linked together to form a ring or may be cyclized to form a saturated hetero ring containing one or more hetero atoms (such as an oxygen atom, a sulfur atom, a nitrogen atom, etc.) therein. As the cyclic group, there may be mentioned a pyrrolidyl group, a piperidyl group, a morpholino group, etc. As the substituents for $R_{11}$ and $R_{12}$, there may be mentioned, for example, a carboxyl group, a sulfo group, a cyano group, a halogen atom (e.g., a fluorine atom, a chlorine atom, a bromine atom), a hydroxyl group, an alkoxycarbonyl group having 20 or less carbon atoms (e.g., a methoxycarbonyl group, an ethoxycarbonyl group, a benzyloxycarbonyl group, etc.), an aryloxycarbonyl group having 20 or less carbon atoms (e.g., a phenoxycarbonyl group, etc.), an alkoxy group having 20 or less carbon atoms (e.g., a methoxy group, an ethoxy group, a benzyloxy group, a phenethyloxy group, etc.), a monocyclic aryloxy group having 20 or less carbon atoms (e.g., a phenoxy group, a p-tolyloxy group, etc.), an acyloxy group having 20 or less carbon atoms (e.g., an acetyloxy group, a propionyloxy group, etc.), an acyl group having 20 or less carbon atoms (e.g., an acetyl group, a propionyl group, a benzoyl group, a mesyl group, etc.), a carbamoyl group (e.g., an unsubstituted carbamoyl group, an N,N-dimethylcarbamoyl group, a morpholinocarbonyl group, a piperidinocarbonyl group, etc.), a sulfamoyl group (e.g., an unsubstituted sulfamoyl group, an N,N-dimethylsulfamoyl group, a morpholinosulfonyl group, a piperidinosulfonyl group, etc.), an acylamino group having 20 or less carbon atoms (e.g., an acetylamino group, a propionylamino group, a benzoylamino group, a mesylamino group, etc.), a sulfonamido group (e.g., an ethylsulfonamido group, a p-toluenesulfonamido group, etc.), a carbonamido group having 20 or less carbon atoms (e.g., a methylcarbonamido group, a phenylcarbonamido group, etc.), a ureido group having 20 or less carbon atoms (e.g., a methylureido group, a phenylureido group, etc.), an amino group (having the same meaning as in formula (VII), etc.

The ammonium group of B may be represented by formula (VIII):

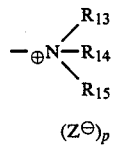

(VIII)

wherein the substituents comprising $R_{13}$, $R_{14}$ and $R_{15}$ are the same as those of $R_{11}$ and $R_{12}$ in the above-mentioned formula (VII); and $Z^{\ominus}$ represents an anion, for example, a halide ion (e.g., $Cl^{\ominus}$, $Br^{\ominus}$, $I^{\ominus}$, etc.), a sulfonato ion (e.g., trifluoromethanesulfonato, paratoluenesulfonato, benzenesulfonato, parachlorobenzenesulfonato, etc.), a sulfato ion (e.g., ethylsulfato, methylsulfato, etc.), a perchlorato, a tetrafluoroborato, etc.; and p represents 0 or 1, provided that when the compound forms an inner salt, p is 0.

The nitrogen-containing heterocyclic group of B is a 5- or 6-membered cyclic group containing at least one or more nitrogen atoms, and the ring may optionally have substituent(s) or may optionally be condensed with other ring(s) such as a benzene ring or a naphthalene ring. As the nitrogen-containing heterocyclic ring, there may, for example, be mentioned an imidazolyl group, a pyridyl group, a thiazolyl group, etc.

Among the compounds of formula (II), those represented by formulae (III), (IV), (V) and (VI) are preferred.

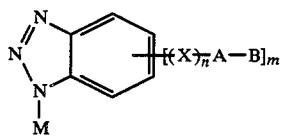
(III)

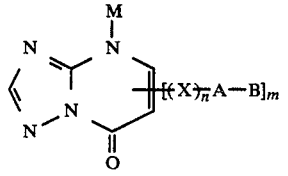
(IV)

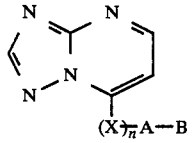
(V)

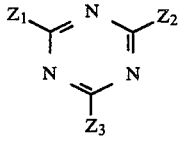
(VI)

wherein X, A, B, M, m and n have the same meaning as those given in the above-mentioned formula (I); and $Z_1$, $Z_2$ and $Z_3$ have the same meaning as $X_nA$-B in the above-mentioned formula (I) or these may independently represent a halogen atom, an alkoxy group having 20 or less carbon atoms (e.g., a methoxy group), a hydroxyl group, a hydroxylamino group, or a substituted or unsubstituted amino group, and the substituents thereof can be selected from the same substituents listed for $R_{11}$ and $R_{12}$ in the above-mentioned formula (VII), provided that at least one of these $Z_1$, $Z_2$ and $Z_3$ must have the same meaning as $X_nA$-B.

In addition, these hetero rings may optionally be substituted by substituent(s) selected from the group which may be applied to the hetero ring of formula (I).

Specific examples of the compounds of formula (I) are shown below, which, however, are not intended to restrict the scope of the present invention.

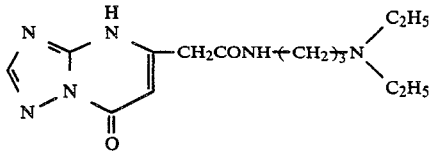
(1.)

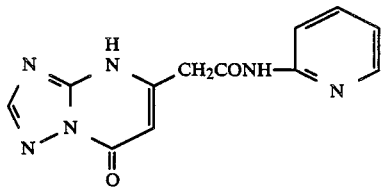
(2.)

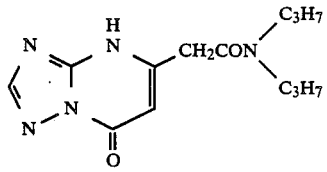
(3.)

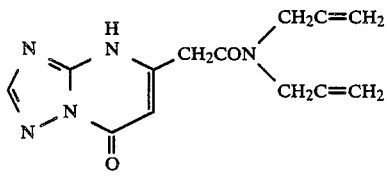
(4.)

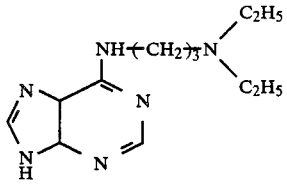
(5.)

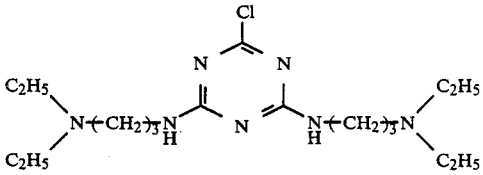
(6.)

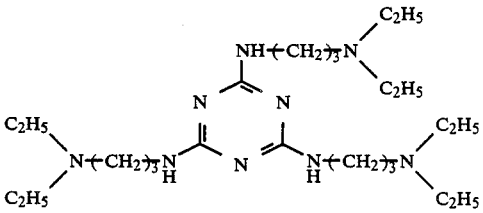
(7.)

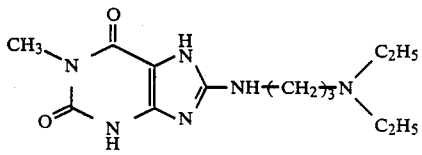
(8.)

-continued
(9.)
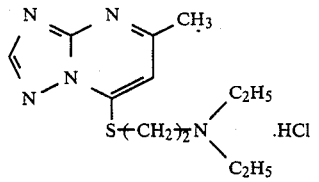
(10.)
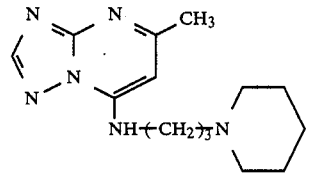
(11.)
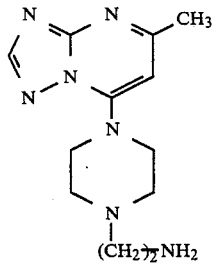
(12.)
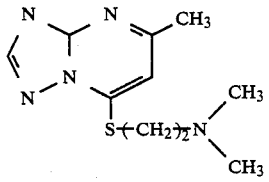
(13.)
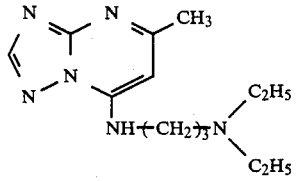
(14.)
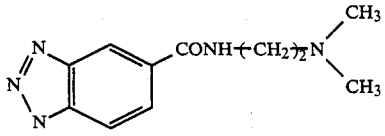
(15.)
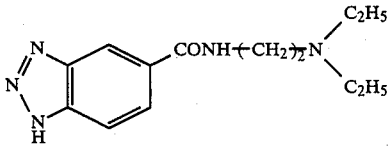
(16.)
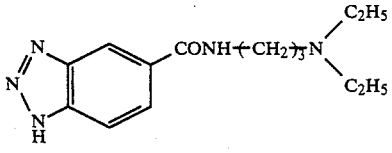
(17.)
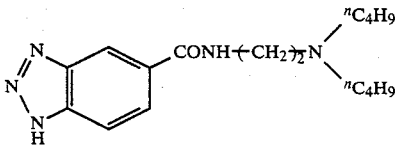
-continued
(18.)
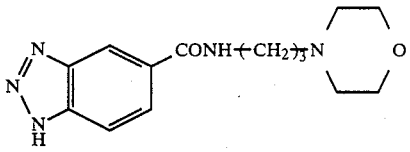
(19.)
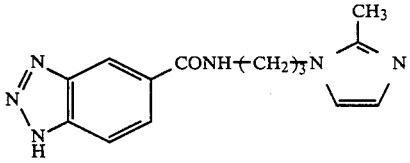
(20.)
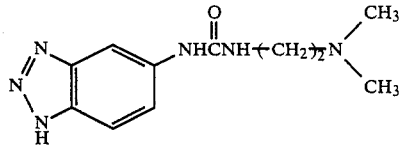
(21.)
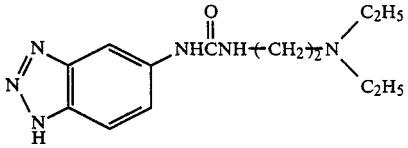
(22.)
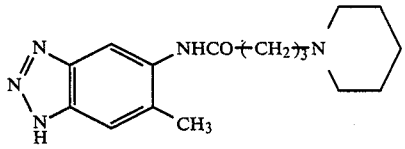
(23.)
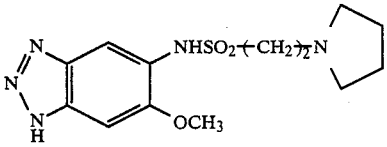
(24.)
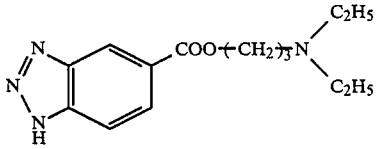
(25.)
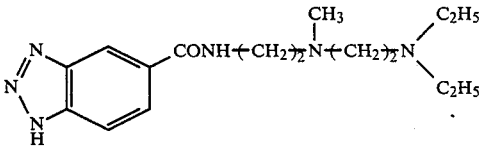
(26.)
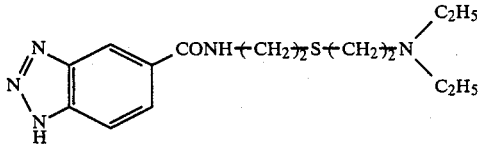
(27.)
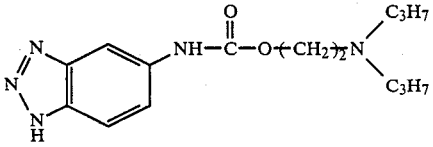

-continued
(28.)
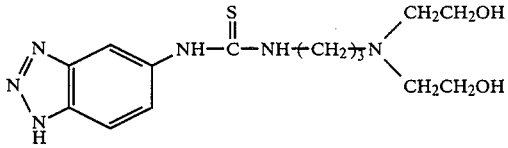
(29.)
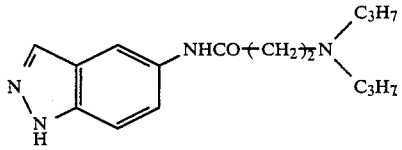
(30.)
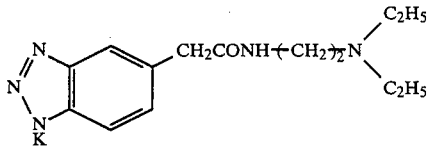
(31.)
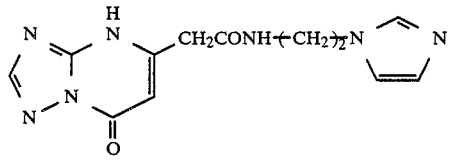
(32.)
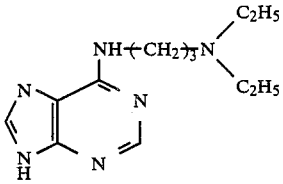
(33.)
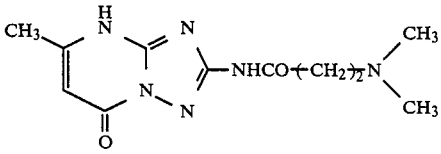
(34.)
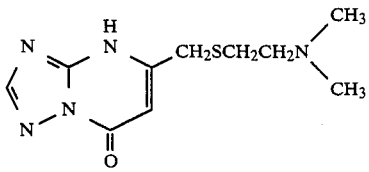
(35.)
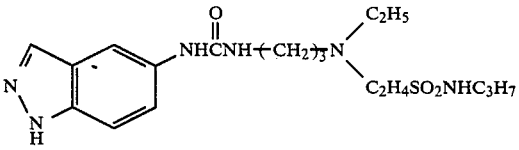
(36.)
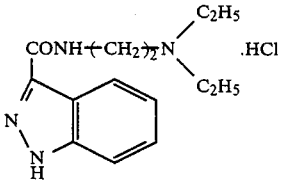
-continued
(37.)
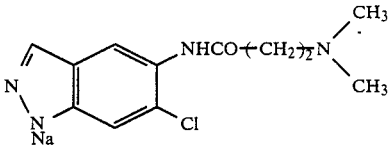
(38.)
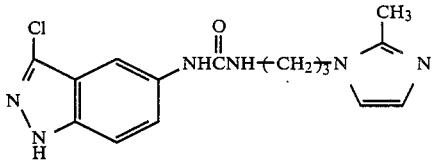
(39.)
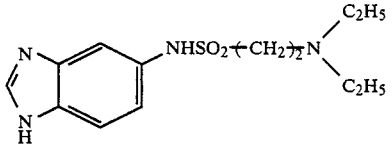
(40.)
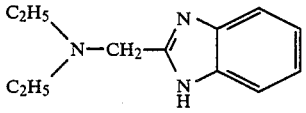
(41.)
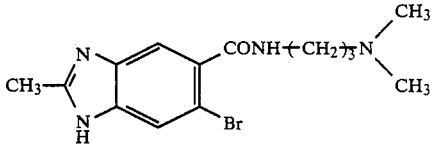
(42.)
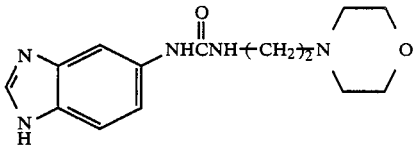
(43.)
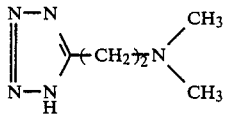
(44.)
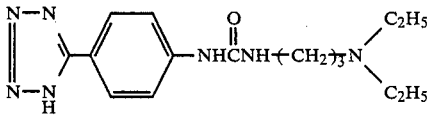
(45.)
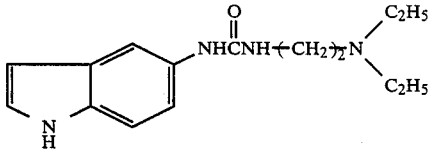
(46.)
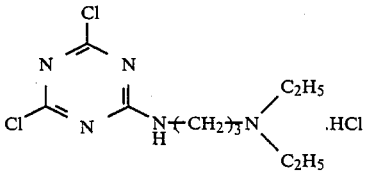

-continued (47.)

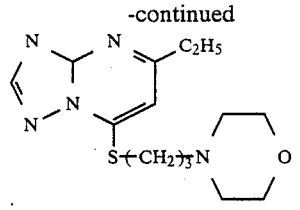

(48.)

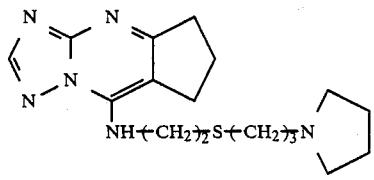

(49.)

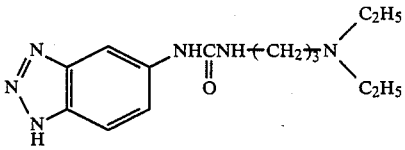

(50.)

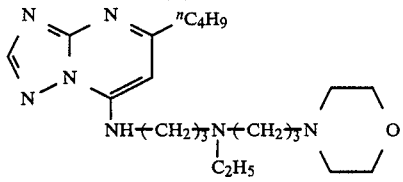

The compound represented by formula (I) for use in the present invention can easily be synthesized by conventional methods, for example, as described in *Berichte der Deutschen Chemischen Gesellschaft,* 28, 77 (1985); Japanese Patent Application (OPI) Nos. 37436/75 and 3231/76; U.S. Pat. Nos. 3,295,976 and 3,376,310; *Berichte der Deutschen Chemischen Gesellschaft,* 22, 568 (1889), ibid., 29, 2483 (1896); *J. Chem. Soc.,* 1932, 1806; *J. Am. Chem. Soc.,* 71, 4000 (1949); U.S. Pat. Nos. 2,585,388 and 2,541,924; *Advances in Heterocyclic Chemistry,* 9, 165 (1968); *Organic Synthesis,* IV, 569 (1963); *J. Am. Chem. Soc.,* 45, 2390 (1923); *Chemische Berichte,* 9, 465 (1876); Japanese Patent Publication No. 28496/65; Japanese Patent Application (OPI) No. 89034/75; U.S. Pat. Nos. 3,106,467, 3,420,670, 2,271,229, 3,137,578, 3,148,066, 3,511,663, 3,060,028, 3,271,154, 3,251,691, 3,598,599 and 3,148,066; Japanese Patent Publication No. 4135/68; U.S. Pat. Nos. 3,615,616, 3,420,664, 3,071,465, 2,444,605, 2,444,606, 2,444,607 and 2,935,404; Japanese Patent Application (OPI) Nos. 202531/82, 167023/82, 164735/82, 80839/85, 152235/83, 14836/82, 162546/84, 130731/85, 138548/85, 83852/83, 159529/83, 159162/84, 217358/85 and 80238/86; Japanese Patent Publication Nos. 29390/85, 29391/85, 133061/85 and 1431/86, etc.

Methods of synthesizing these contrast enhancers are set forth below. Unless otherwise indicated, all parts, percentages, ratios and the like are by weight.

SYNTHESIS EXAMPLE 1

Synthesis of the Above-Mentioned Compound (1)

250 ml of dimethylformamide was added to 19.4 g of 6-carboxymethyl-4-hydroxy-1,3,3a,7-tetraazaindene and 14.3 g of N,N-diethyltrimethylenediamine, followed by dropwise addition of 22.6 g of dicyclohexylcarbodiimide thereto at room temperature. After stirring for 5 hours as such, the crystal precipitate was separated by filtration, and the resulting filtrate was dried under reduced pressure. The solid obtained was recrystallized from 400 ml of a mixed solvent of methyl alcohol/acetone (1/1), to obtain 18.0 g of the desired product. M.P.: 214°–215° C.

SYNTHESIS EXAMPLE 2

Synthesis of the Above-Mentioned Compound (6)

300 ml of a solution of acetonitrile containing 55.3 g of cyanuric chloride was cooled to 5° C. or lower and stirred. While kept at 5° C. or lower, 78.1 g of 3-diethylaminopropylamine was dropwise added, and after addition, the mixture was stirred for 3 hours at room temperature. The crystal precipitate was separated by filtration and dissolved in 1 liter of water, and then an aqueous solution comprising 300 ml of water and 26 g of sodium hydroxide was dropwise added thereto at room temperature. The crystal thus-formed was recrystallized from n-hexane to obtain 0.6 g of the desired product. M.P.: 118°–119° C.

SYNTHESIS EXAMPLE 3

Synthesis of the Above-Mentioned Compound (9)

33.2 g of potassium carbonate and 100 ml of ethanol were added to 13.5 g of 4-chloro-6-methyl-1,3,3a,7-tetraazaindene and 13.6 g of 2-diethylaminoethylmercaptan and heated under reflux for 2 hours. After the mixture was cooled to room temperature, it was concentrated under reduced pressure. 100 ml of water was added to the concentrate, and then this mixture was extracted with 100 ml portion of ethyl acetate (two times). After the organic layer was dried with magnesium sulfate, the solvent was evaporated away under reduced pressure, and the solid obtained was dissolved in and recrystallized from acetonitrile to obtain 6.6 g of the desired product. M.P.: 193°–195° C.

SYNTHESIS EXAMPLE 4

Synthesis of the Above-Mentioned Compound (14)

150 ml of benzene was added to 1.2 g of 5-phenoxycarbonylbenzotriazole and 4.4 g of N,N-dimethylethylenediamine and heated under reflux for 4 hours. After cooled to room temperature, the crystal precipitate was separated by filtration and recrystallized from methyl alcohol to obtain 7.9 g of the desired product. M.P.: 182°–184° C.

SYNTHESIS EXAMPLE 5

Synthesis of the Above-Mentioned Compound (15)

500 ml of acetonitrile and 32.0 g of N,N-diethylethylenediamine were added to 60.0 g of 5-phenoxycarbonylbenzotriazole and heated under reflux for 4 hours. After the reaction, the reaction solution was stirred with cooling in an ice bath, and the crystal precipitate was taken out by filtration. The filtrate was recrystallized from 400 ml of methyl alcohol to obtain 56.1 g of the desired product. M.P.: 164°–165° C.

SYNTHESIS EXAMPLE 6

Synthesis of the Above-Mentioned Compound (16)

200 ml of acetonitrile and 14.3 g of N,N-diethyltrimethylenediamine were added to 23.9 g of 5-phenoxycarbonylbenzotriazole and heated under reflux for 4 hours. After the reaction, the reaction solution was stirred with cooling in an ice bath and the crystal precipitate was taken out by filtration. The filtrate was recrystallized from 200 ml of a mixed solvent of acetonitrile/ethyl alcohol (1/1) to obtain 23.0 g of the desired product. M.P.: 104°-108° C.

SYNTHESIS EXAMPLE 7

Synthesis of the Above-Mentioned Compound (18)

200 ml of acetonitrile and 15.8 g of 3-aminopropylmorpholine were added to 23.9 g of 5-phenoxycarbonylbenzotriazole and heated under reflux for 4 hours. After the reaction, the reaction solution was concentrated to dryness under reduced pressure, and the oily substance obtained was recrystallized from 250 ml of a mixed solvent of ethyl alcohol/ethyl acetate/n-hexane (4/3/3) to obtain 23.4 g of the desired product. M.P.: 136°-138° C.

SYNTHESIS EXAMPLE 8

Synthesis of the Above-Mentioned Compound (19)

200 ml of acetonitrile and 5.3 g of 1-(3-aminopropyl)-2-methylimidazole were added to 23.9 g of 5-phenoxycarbonylbenzotriazole and heated under reflux for 4 hours. After the reaction, the reaction solution was stirred with cooling in an ice bath, and the crystal precipitate was recrystallized from 200 ml of methyl alcohol to obtain 15.9 g of the desired product. M.P.: 231°-233° C.

SYNTHESIS EXAMPLE 9

Synthesis of the Above-Mentioned Compound (20)

40 ml of acetonitrile was added to 7.6 g of 5-phenoxycarbonylaminobenzotriazole produced in Synthesis Example 6, and 3.2 g of N,N-dimethylethylenediamine was dropwise added thereto with stirring at 40° C., and after the addition, the solution was stirred for 1 hour as such. After the reaction, the reaction solution was cooled in an ice bath, and the crystal precipitate was taken out by filtration and then recrystallized from 130 ml of a mixed solvent of methyl alcohol/dimethylformamide (10/3) to obtain 4.1 g of the desired product. M.P.: 207°-210° C.

SYNTHESIS EXAMPLE 10

Synthesis of the Above-Mentioned Compound (21)

500 ml of dimethylacetamide was added to 62.1 g of 5-aminobenzotriazole dihydrochloride, and 83.7 ml of triethylamine was dropwise added thereto with cooling in an ice bath. Further, 21.0 ml of pyridine was dropwise added, followed by dropwise addition of 42.3 g of phenyl chlorocarbonate at 5° C. or lower, and then, the whole was stirred for 2 hours at room temperature. After the reaction, the reaction solution was poured into 2 liters of water for crystallization, and the crystal formed was taken out by filtration to obtain 60.8 g of 5-phenoxycarbonylaminobenzotriazole. To 5.1 g of 5-phenoxycarbonylaminobenzotriazole thus-obtained was added 40 ml of acetonitrile, and 2.6 g of N,N-diethylethylenediamine was dropwise added thereto with stirring at 45° C., and then the whole was stirred for 2 hours as such. After the reaction, the reaction solution was cooled in an ice bath, and the crystal precipitate was taken out by filtration and recrystallized from 60 ml of a mixed solvent of methyl alcohol/acetonitrile (1/5) to obtain 3.8 g of the desired product. M.P.: 149°-150° C.

SYNTHESIS EXAMPLE 11

Synthesis of the Above-Mentioned Compound (34)

200 ml of acetonitrile was added to 28.3 g of 2-dimethylaminoethanethiol hydrochloride, and after 80 ml of sodium methoxide-containing 28% methyl alcohol solution was added thereto with cooling in an ice bath, 32.9 g of ethyl 4-chloroacetoacetate was dropwise added thereto with cooling in an ice bath. After the dropwise addition, the whole was stirred for 2 hours at 40° C., and then the inorganic salt was separated by filtration and the resulting filtrate was dried under reduced pressure. The oily substance obtained was purified by silica gel column chromatography (with moving phase solvent of chloroform/methyl alcohol, 10/1) to obtain 41.8 g of ethyl 4-(2-dimethylaminoethylthio)acetoacetate. To 23.3 g of the ethyl 4-(2-dimethylaminoethylthio)acetoacetate thus-obtained were added 8.4 g of 3-amino-1,2,4-triazole and 4.0 ml of acetic acid, and the whole was heated under reflux for 4 hours. After the reaction, 100 ml of methyl alcohol was added to the reaction solution and stirred with cooling in an ice bath, and the crystal precipitate was taken out by filtration and recrystallized from 300 ml of methyl alcohol to obtain 10.2 g of the desired product. M.P.: 109°-110° C.

SYNTHESIS EXAMPLE 12

Synthesis of the Above-Mentioned Compound (49)

40 ml of acetonitrile was added to 7.6 g of 5-phenoxycarbonylaminobenzotriazole as obtained in Synthesis Example 6, followed by dropwise addition of 4.8 g of N,N-diethyltrimethylenediamine thereto with stirring at 45° C., and the whole was stirred for 3 hours as such. After the reaction, the reaction solution was cooled in an ice bath, and the crystal precipitate was taken out by filtration and recrystallized from 55 ml of a mixed solvent of methyl alcohol/acetonitrile (3/8) to obtain 5.4 g of the desired product. M.P.: 151°-152° C.

Regarding these contrast enhancers represented by formula (I), the optimum amount to be added to the photographic materials of the present invention varies depending upon the kind of the compounds and, in general, the amount desired to be used ranges from $1.0\times10^{-3}$ to 0.5 g/m$^2$, preferably from $5.0\times10^{-3}$ to 0.1 g/m$^2$. The contrast enhancer is dissolved in a suitable solvent ($H_2O$, alcohols such as methanol or ethanol, or acetone, dimethylformamide, methyl cellosolve, etc.) and is added to the coating solution.

The compounds represented by formula (I) can be used in the form of a combination of two or more kinds thereof.

As the hydrazine derivatives for use in the present invention, there may be mentioned the sulfinyl group-containing hydrazine derivatives described in U.S. Pat. No. 4,478,928 as well as the compound represented by the following general formula (X):

$$\text{R-NHNHCHO} \qquad \text{(X)}$$

wherein R represents an aliphatic group or an aromatic group.

In formula (X), the aliphatic group as represented by R is preferably a substituted or unsubstituted straight or branched chain or cyclic alkyl group having from 1 to 30 carbon atoms, and more preferably from 1 to 20 carbon atoms. The branched alkyl group may be cyclized to form a saturated hetero ring containing at least one atom which is not carbon. The substituents for the alkyl group include an aryl group, an alkoxy group, a sulfoxy group, a sulfonamido group, a carbonamido group, etc.

Specific examples of the aliphatic group for R include a t-butyl group, an n-octyl group, a t-octyl group, a cyclohexyl group, a pyrrolidyl group, an imidazolyl group, a tetrahydrofuryl group, a morpholino group, etc.

The aromatic group as represented by R of formula (X) is a substituted or unsubstituted monocyclic or bicyclic aryl group or a substituted or unsubstituted unsaturated heterocyclic group. The unsaturated heterocyclic group may be condensed with a monocyclic or bicyclic aryl group to form a heteroaryl group.

Specific examples of the aromatic group include a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc. Of these, those containing a benzene ring are preferred.

The aromatic group may have one or more substituents. Typical substituents for the aromatic group include a straight or branched chain or cyclic alkyl group (preferably having from 1 to 20 carbon atoms), an aralkyl group (preferably comprising a monocyclic or bicyclic aryl moiety and an alkyl moiety having from 1 to 3 carbon atoms), an alkoxy group (preferably having from 1 to 20 carbon atoms), a substituted amino group (preferably substituted by an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and the like.

In particular, R preferably represents a monocyclic or bicyclic aryl group.

The aliphatic or aromatic group as represented by R may have incorporated therein a ballast group commonly employed in nondiffusible photographic additives, such as couplers. The ballast group is selected from those groups that contain 8 or more carbon atoms and are relatively inert to photographic characteristics, such as an alkyl group, an alkoxy group, a phenyl group, an alkylphenyl group, a phenoxy group, an alkylphenoxy group, and the like.

The aliphatic or aromatic group as represented by R may further have incorporated therein a group enhancing adsorption onto silver halide grains. Such an adsorptive group includes a thiourea group, a heterocyclic thioamido group, a mercapto heterocyclic group, a triazole group, etc., as described in U.S. Pat. Nos. 4,385,108.

Methods of synthesizing the compounds of formula (X) are described, e.g., in Japanese Patent Application (OPI) Nos. 20921/78, 20922/78, 66732/78 and 20318/78.

The hydrazine derivative of formula (X) according to the present invention is preferably incorporated in a silver halide emulsion layer, but may be incorporated in any other light-insensitive hydrophilic colloid layer, such as a protective layer, an intermediate layer, a filter layer, an antihalation layer, and the like. Incorporation of the compound of formula (X) can be carried out by dissolving it in water in the case of using a water-soluble compound or in a water-miscible organic solvent, e.g., alcohols, esters, ketones, etc., in the case of using a sparingly water-soluble compound, and adding the solution to a hydrophilic colloid solution. When it is added to a silver halide emulsion layer, addition may be effected at any stage of from the commencement of chemical ripening up to the stage immediately before coating, and preferably from the end of chemical ripening to the stage before coating. In particular, the compound is preferably added to a coating composition ready to be coated.

The amount of the compound of formula (X) to be added is desirably selected so as to obtain best results according to the grain size and halogen composition of silver halides, the method and degree of chemical sensitization, the relation between the layer to which the compound is added and a silver halide emulsion layer, the kind of antifoggant used, and the like. Such selection can be made easily by one skilled in the art. Usually, the compound of formula (X) is preferably used in an amount of from $10^{-6}$ to $1\times10^{-1}$ mol and more preferably from $10^{-5}$ to $4\times10^{-2}$ mol, per mol of total silver halide.

Specific but nonlimiting examples of the compounds represented by formula (X) are shown below.

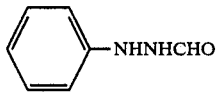

(X-1)

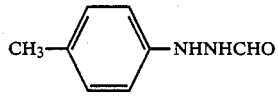

(X-2)

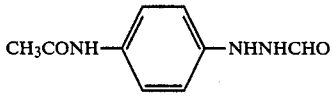

(X-3)

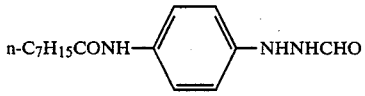

(X-4)

-continued
(X-5)
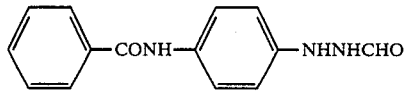
(X-6)
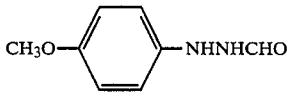
(X-7)
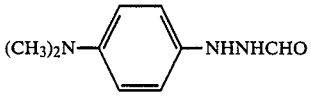
(X-8)
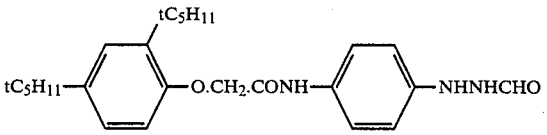
(X-9)
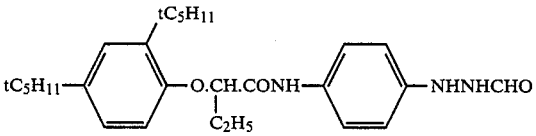
(X-10)
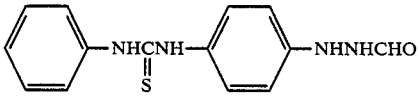
(X-11)
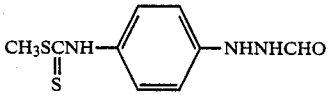
(X-12)
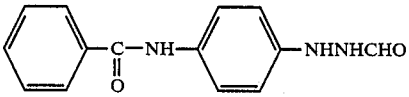
(X-13)
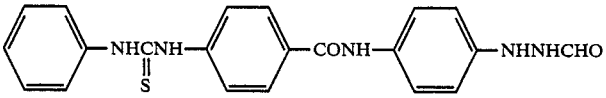
(X-14)
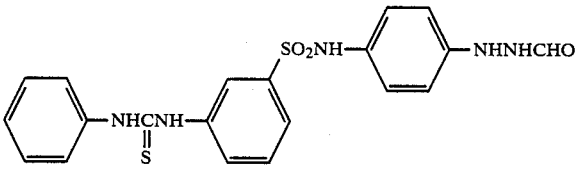
(X-15)
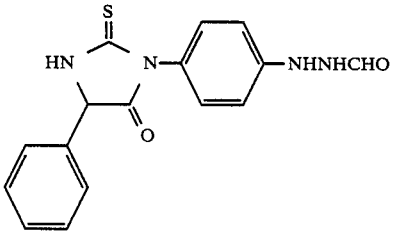

-continued
(X-16)
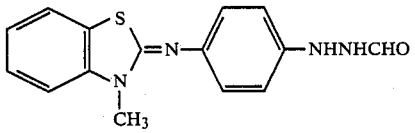
(X-17)
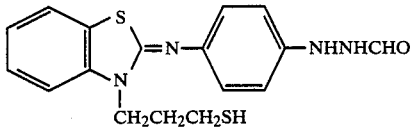
(X-18)
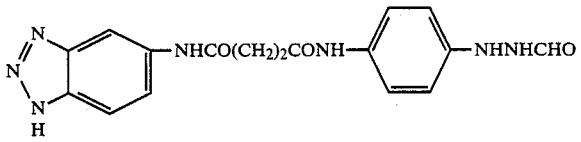
(X-19)
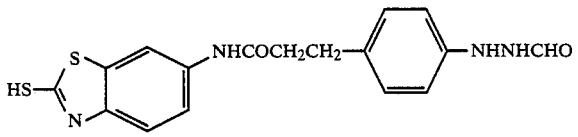
(X-20)
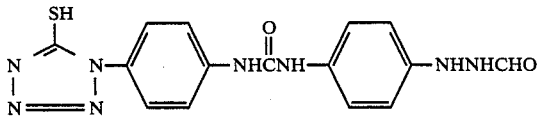
(X-21)
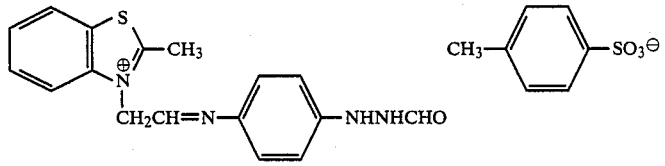
(X-22)
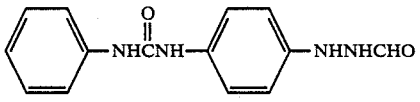
(X-23)
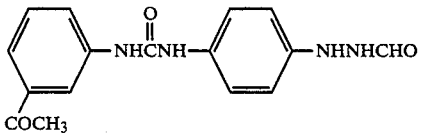
(X-24)
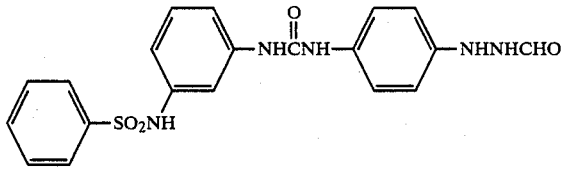
(X-25)
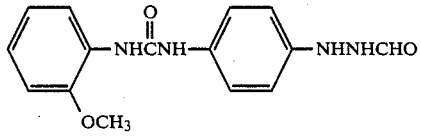

-continued (X-26)

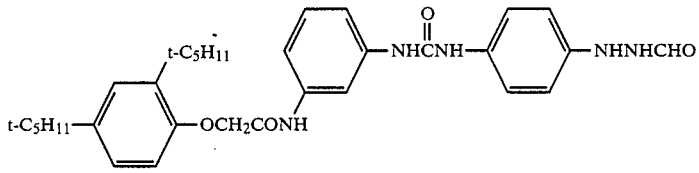

(X-27)

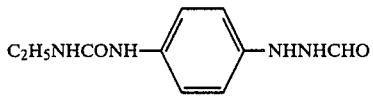

(X-28)

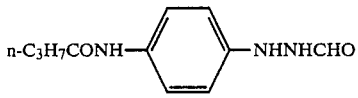

(X-29)

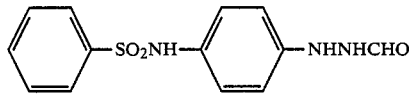

(X-30)

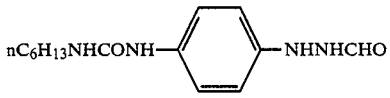

(X-31)

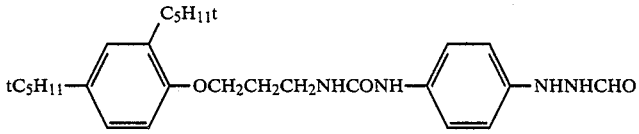

(X-32)

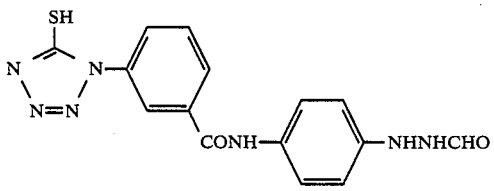

(X-33)

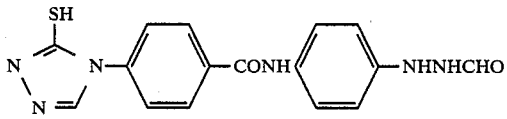

In addition, compounds disclosed in U.S. Pat. No. 4,478,928, such as those shown below, may also be used.

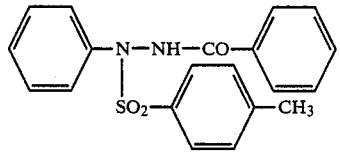

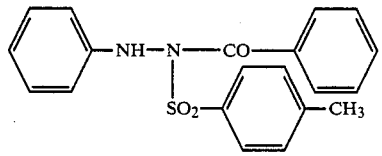

-continued

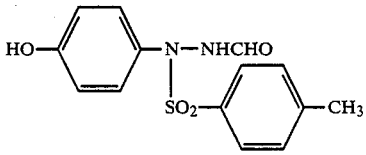

The photographic material of the present invention preferredly contains an organic desensitizer. The organic desensitizer is one having a positive polarographic half-wave potential, which means that the sum of the polarographic positive potential and negative potential, as defined by the polarographical redox potential, is positive. The measurement of the polarographical redox potential is described, for example, in U.S. Pat. No. 3,501,307.

The organic desensitizer for use in the present invention preferably has at least one water-soluble group or alkali dissociating group. The present inventors are the first to find out that the incorporation of the organic desensitizer into a hydrazine compound-containing high contrast photographic material is effective for lowering the sensitivity of the material without interfering with the high contrast thereof. The phenomenon which would occur in the system is extremely complicated, and the mechanism is not clarified at present. Under the circumstances, the present inventors presume as follows: The organic desensitizer acts to accept photoelectrons to interfere with the latent image formation in the step of imagewise exposure, as mentioned above, whereby the sensitivity of the photographic material is lowered. While the material is dissolved in the processing solution or is in a separated state from the silver halide grains in the step of the successive development processing, the desensitizer no longer effectively acts as an acceptor for the electrons donated from the hydrazine compound in the development stage and, as a result, the intensification of the high contrast of the photographic material by the action of the hydrazine compound can well proceed. Such organic desensitizer must contain at least one water-soluble group, which includes, for example, a sulfonic acid group, a carboxylic acid group and a phosphonic acid group. These groups can be in the form of a salt, for example, with an organic base (e.g., ammonia, pyridine, triethylamine, piperidine, morpholine, etc.) or an alkali metal (e.g., sodium, potassium, etc.).

The term "alkali dissociating group" means a substituent that causes a deprotonization reaction to become anionic at or below the pH of a developing solution (generally, a developing solution has a pH range of from 9 to 13, although the developing solution may have a pH outside this range), and specifically refers to a substituent having at least one hydrogen atom attached to a nitrogen atom such as a substituted or unsubstituted sulfamoyl group, a substituted or unsubstituted carbamoyl group, a sulfonamido group, an acylamino group and a substituted or unsubstituted ureido group and a hydroxyl group.

The alkali dissociating group also includes a nitrogen-containing heterocyclic ring group having a hydrogen atom on the nitrogen atom constituting the nitrogen-containing heterocyclic ring.

These water-soluble groups and alkali dissociating groups may be attached to any part of the organic desensitizer, and the organic desensitizer may have two or more such groups at the same time.

Preferable organic desensitizers used in the present invention include compounds represented by the following formulae (XI) to (XIII):

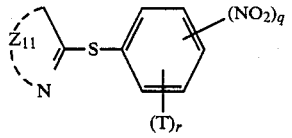

(XI)

wherein T represents an alkyl group (preferably having 1 to 18 carbon atoms), a cycloalkyl group (preferably having 3 to 18 carbon atoms), an alkenyl group (preferably having 2 to 18 carbon atoms), a halogen atom, a cyano group, a trifluoromethyl group, an alkoxy group (preferably having 1 to 18 carbon atoms), an aryloxy group (preferably having 6 to 12 carbon atoms), a hydroxy group, an alkoxycarbonyl group (preferably having 2 to 18 carbon atoms), a carboxyl group, a carbamoyl group, a sulfamoyl group, an aryl group (preferably having 6 to 12 carbon atoms), an acylamino group (preferably having 2 to 18 carbon atoms), a sulfonamido group (preferably having 1 to 18 carbon atoms), a sulfo group or a benzocondensed ring, which may or may not have one or more substituents; $Z_{11}$ represents a group of nonmetal atoms required to complete a nitrogen-containing heterocyclic ring; q is 1, 2 or 3; and r is 0, 1 and 2;

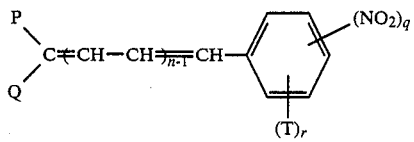

(XII)

wherein P and Q, which may be the same or different, each represents a cyano group, an acyl group (preferably having 2 to 18 carbon atoms), a thioacyl group (preferably having 2 to 18 carbon atoms), an alkoxycarbonyl group (preferably having 2 to 18 carbon atoms), an alkylsulfonyl group (preferably having 1 to 18 carbon atoms), an arylsulfonyl group (preferably having 6 to 12 carbon atoms), a substituted or unsubstituted sulfamoyl group, a substituted or unsubstituted carbamoyl group, a nitro group, or a substituted or unsubstituted aryl group; n is 1, 2 or 3; and T, r and q have the same meaning as defined in formula (XI) above; and

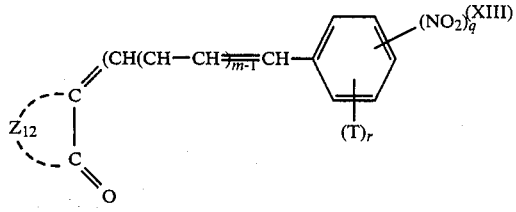

(XIII)

wherein $Z_{12}$ represents a group of nonmetal atoms required to complete a ketomethylene ring; m is 1, 2 or 3; and T, r and q have the same meaning as defined in formula (XI) above.

With the proviso that substituents $Z_{11}$, $Z_{12}$, T, P and Q in formulae (XI) to (XIII) have at least one water-soluble group or alkali dissociating group.

In formula (XI), the nonmetal atoms represented by $Z_{11}$ may, for instance, be comprised of one or more nitrogen, oxygen, sulfur and carbon atoms, which may or may not be substituted with one or more substituents and which form a ring containing at least three members, which may be further fused to one or more additional rings. The substituents may, for instance, by oxygen atoms, sulfur atoms, and oxygen-, sulfur-, nitrogen-, and carbon-containing groups.

In formulae (XI) to (XIII), the substituents for T include an alkyl group having 1 to 18 carbon atoms, a cycloalkyl group having 3 to 18 carbon atoms, an alkenyl group having 2 to 18 carbon atoms, an alkoxy group having 1 to 18 carbon atoms, an aryloxy group having 6 to 12 carbon atoms, an alkoxycarbonyl group having 2 to 18 carbon atoms, an aryl group having 6 to 12 carbon atoms, an acylamino group having 2 to 18 carbon atoms, a sulfonamido group having 1 to 18 carbon atoms, a halogen atom, a cyano group, a trifluoromethyl group, a hydroxy group, a carboxyl group, and a sulfo group.

In formula (XII), the substituents of the substituted sulfamoyl, carbamoyl, and aryl groups for P and Q include the same groups as exemplified for the substituents for T in formulae (XI) to (XIII).

Specific examples of nitrogen-containing heterocyclic rings completed through $Z_{11}$ include a 1,2,4-triazole ring, a 1,3,4-oxadiazole ring, a 1,3,4-thiadiazole ring, a tetraazaindene ring, a pentaazaindene ring, a triazaindene ring, a benzothiazole ring, a benzimidazole ring, a benzoxazole ring, a pyrimidine ring, a triazine ring, a pyridine ring, a quinoline ring, a quinazoline ring, a phthalazine ring, a quinoxaline ring, an imidazo[4,5-b]quinoxaline ring, a tetrazole ring and a 1,3-diazaazulene ring, which may or may not have one or more substituents or may be fused with one or more additional aromatic rings such as a benzene ring, a naphthalene ring, an anthracene ring, a pyridine ring, a pyrazine ring, and a pyrimidine ring.

In formula (XIII), the nonmetal atoms represented by $Z_{12}$ may, for instance, be comprised of one or more nitrogen, oxygen, sulfur and carbon atoms, which may or may not be substituted with one or more substituents and which form a 4- to 7-membered ring, which may be further fused to one or more additional rings. The substituents may, for example, be oxygen atoms, sulfur atoms, and oxygen-, sulfur- and nitrogen-containing groups.

Specific examples of ketomethylene rings completed through $Z_{12}$ include a pyrazolone ring, an isoxazolone ring, an oxindol ring, a barbituric ring, a thiobarbituric ring, a rhodanine ring, an imidazo[1,2-a]pyridone ring, a 2-thio-2,4-oxazolidinedione ring, a 2-thio-2,5-thiazolidinedione ring, a thiazolidone ring, a 4-thiazolone ring, a 2-imino-2,4-oxazolinone ring, a 2,4-imidazolinedione ring (a hydantoin ring), a 2-thiohydantoin ring and a 5-imidazolone ring.

Specific examples of the compounds represented by formulae (XI) to (XIII) are given below, but the present invention is not limited to these compounds:

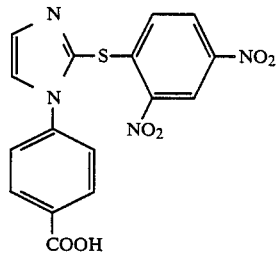

(XI-1)

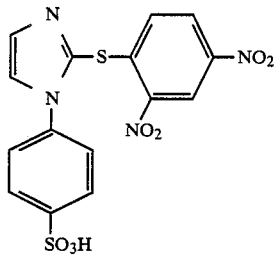

(XI-2)

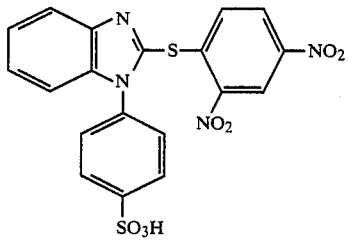

(XI-3)

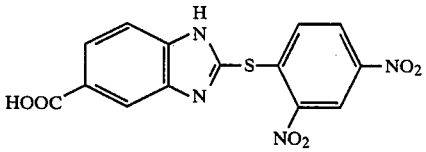

(XI-4)

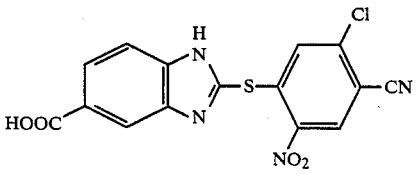

(XI-5)

-continued
(XI-6)
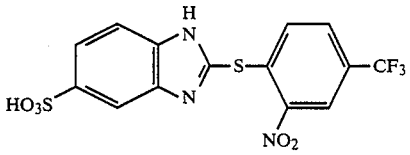
(XI-7)
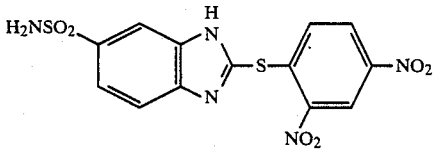
(XI-8)
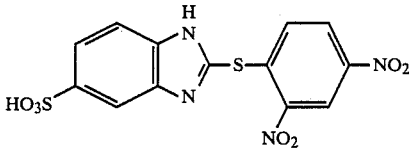
(XI-9)
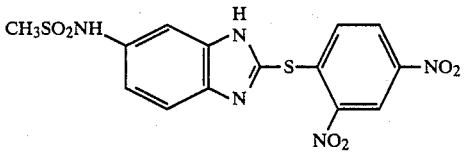
(XI-10)
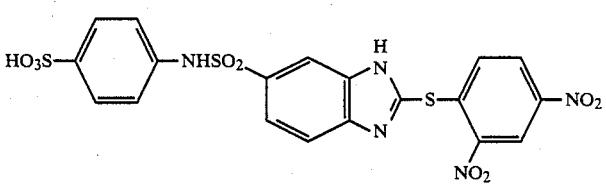
(XII-1)
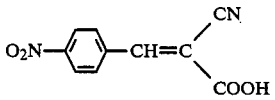
(XII-2)
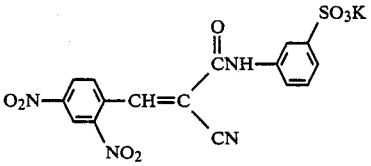
(XII-3)
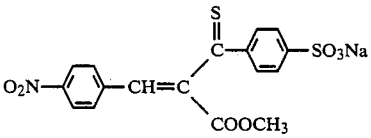
(XII-4)
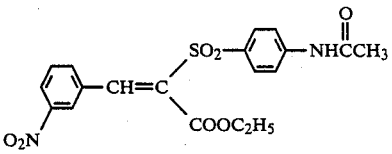
(XII-5)
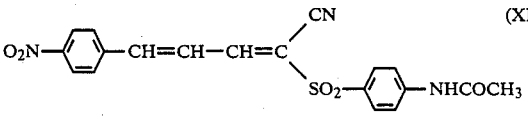
-continued
(XII-6)
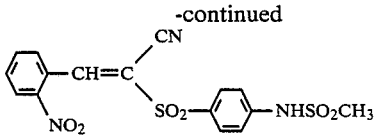
(XIII-1)
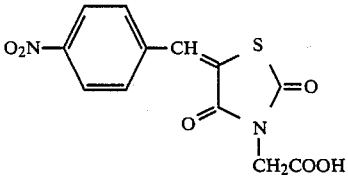
(XIII-2)
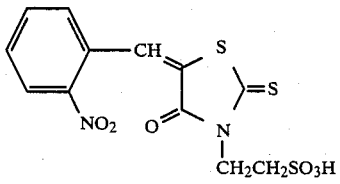

-continued (XIII-3)

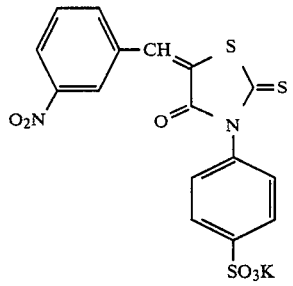

(XIII-4)

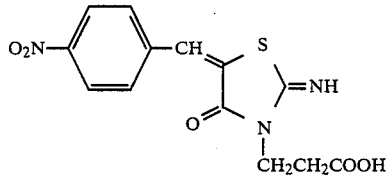

(XIII-5)

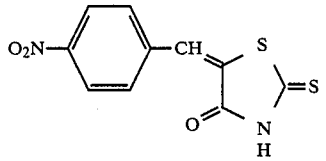

(XIII-6)

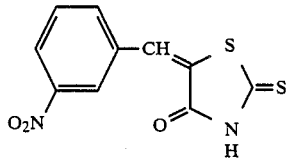

(XIII-7)

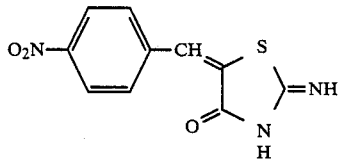

(XIII-8)

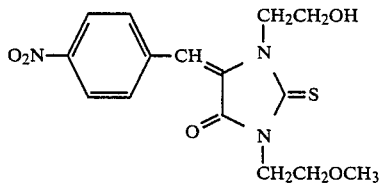

(XIII-9)

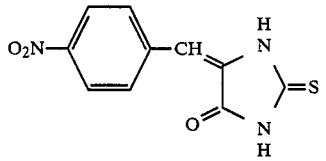

The organic desensitizer is preferably present in a silver halide emulsion layer in an amount of from $1.0\times10^{-8}$ to $1.0\times10^{-4}$ mol/m$^2$, and more preferably from $1.0\times10^{-7}$ to $1.0\times10^{-5}$ mol/m$^2$.

The emulsion layers or other hydrophilic colloid layers of the photographic materials of the present invention can contain water-soluble dyes as safelight dyes or anti-irradiation dyes or for other various purposes. Water-soluble dyes suitable as safe-light dyes are dyes for further reducing photographic sensitivity, and preferably ultraviolet absorbents having a spectral absorption maximum in an inherent sensitivity region of silver halide, and dyes for ensuring safety against safelight under which the bright room-type photographic materials are processed, and preferably those showing substantial light absorption in the region of from 380 nm to 600 nm.

These dyes are preferably incorporated into the emulsion layers or layers above the silver halide emulsion layers, i.e., light-insensitive hydrophilic colloid layers farther from a support than the silver halide emulsion layers according to the end use and fixed therein with the aid of a mordant.

The amount of the ultraviolet absorbent to be added, though varying depending on molar extinction coefficient, usually ranges from $10^{-2}$ to 1 g/m$^2$, and preferably from 50 to 500 mg/m$^2$.

Incorporation of the ultraviolet absorbent in a coating solution can be carried out by dissolving it in an appropriate solvent, such as water, alcohols (e.g., methanol, ethanol, propanol, etc.), acetone, methyl cellosolve, etc., and mixtures thereof, and dispersing the solution in a coating solution.

The ultraviolet absorbent which can be used in the present invention includes aryl-substituted benzotriazole compounds, 4-thiazolidone compounds, benzophenone compounds, cinnamic ester compounds, butadiene compounds, benzoxazole compounds, and ultraviolet absorbing polymers. Specific examples of these ultraviolet absorbents are described in U.S. Pat. Nos. 3,533,794, 3,314,794 and 3,352,681, Japanese Patent Application (OPI) No. 2784/71, U.S. Pat. Nos. 3,705,805, 3,707,375, 4,045,229, 3,700,455 and 3,499,762, West German Patent Application (OLS) No. 1,547,863, etc.

Specific but nonlimiting examples of the ultraviolet absorbents to be used in the present invention are shown below.

1

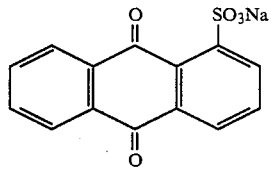

2

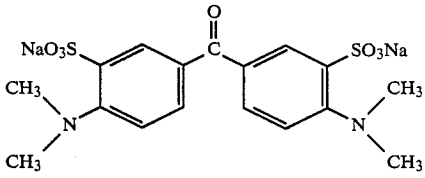

3

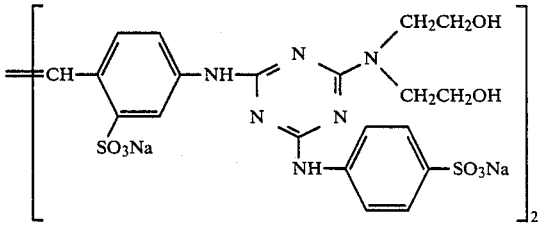

-continued

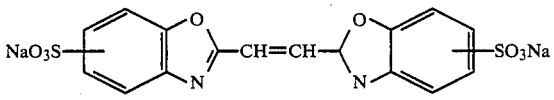

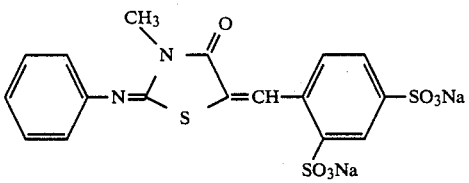

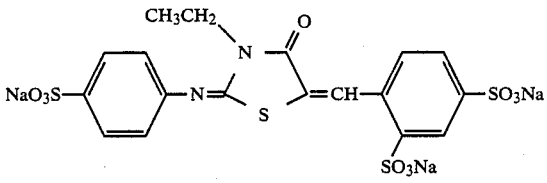

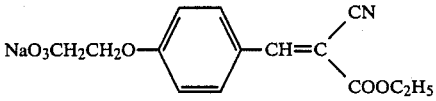

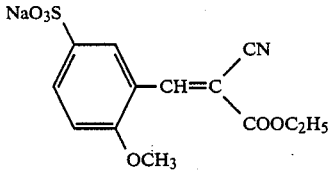

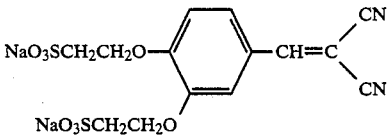

The safelight dyes which can be used in the present invention include oxonol dyes, hemioxonol dyes, styryl dyes, merocyanine dyes, cyanine dyes, and azo dyes. From the standpoint of minimizing color retention after development processing, water-soluble dyes or dyes decolorizable with an alkali or a sulfite ion are preferred. Examples of such filter dyes are the pyrazoloneoxonol dyes disclosed in U.S. Pat. No. 2,274,782; the diarylazo dyes disclosed in U.S. Pat. No. 2,956,879; the styryl dyes or butadienyl dyes disclosed in U.S. Pat. Nos. 3,423,207 and 3,384,487; the merocyanine dyes disclosed in U.S. Pat. No. 2,527,583; the merocyanine dyes or oxonol dyes disclosed in U.S. Pat. Nos. 3,486,897, 3,652,284 and 3,718,472; the enaminohemioxonol dyes disclosed in U.S. Pat. No. 3,976,661; and the dyes disclosed in British Pat. Nos. 584,609 and 1,177,429, Japanese Patent Application (OPI) Nos. 85130/73, 99620/74 and 114420/74, U.S. Pat. Nos. 2,533,472, 3,148,187, 3,177,078, 3,247,127, 3,540,887, 3,575,704 and 3,653,905.

Specific examples of these filter dyes can be represented by the following formulae (XIV) to (XIX).

Formula (XIV) is represented by

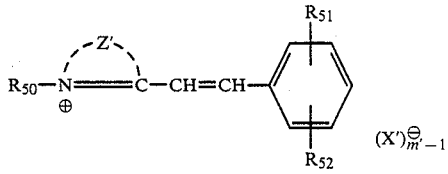

(XIV)

wherein Z' represents a nonmetal atomic group necessary for forming a benzothiazole ring, a naphthothiazole ring or a benzoxazole ring; $R_{50}$ represents a substituted or unsubstituted alkyl group; $R_{51}$ and $R_{52}$, which may be the same or different, each represents a hydrogen atom, an alkoxy group, a dialkylamino group or a sulfo group; X' represents an anion; and m' represents 1 or 2.

In formula (XIV) when m' is 1, the compound is in the form of an inner salt.

Substitutents for the alkyl group which may be substituted of $R_{50}$ include an alkoxy group (preferably having from 1 to 20 carbon atoms), an aryloxy group (preferably having from 6 to 10 carbon atoms), an alkoxycarbonyl group (preferably having from 2 to 20 carbon atoms), a carboxy group, a sulfo group, a halogen atom, a hydroxy group, an aryl group (preferably having from 6 to 10 carbon atoms), and a cyano group.

Specific examples of the anion of X' are a halogen anion (e.g., chloride, bromide and iodide), a perchlorate, a tetrafluoroborate, a hexafluorophosphate, a p-toluenesulfonate, a methanesulfonate, and an ethylsulfonate.

Formula (XV) is represented by

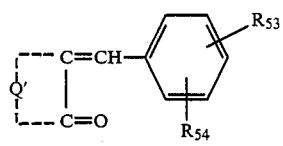

(XV)

wherein Q' represents an atomic group necessary for forming a pyrazolone ring, a barbituric acid ring, a thiobarbituric acid ring, an isoxazolone ring, a 3-oxythionaphthene ring or a 1,3-indanedione ring; and $R_{53}$ and $R_{54}$, which may be the same or different, each represents a hydrogen atom, an alkoxy group, a dialkylamino group or a sulfo group.

Formula (XVI) is represented by

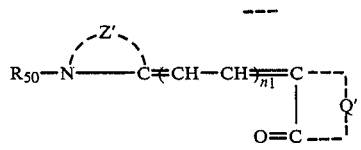

(XVI)

wherein Z', Q' and $R_{50}$ are as defined above; and $n_1$ represents 1 or 2.

Formula (XVII) is represented by

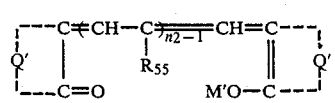

(XVII)

wherein Q' is as defined above; $R_{55}$ represents a hydrogen atom or a halogen atom; M' represents a hydrogen atom, a sodium atom or a potassium atom; and $n_2$ represents 1 or 2.

Formula (XVIII) is represented by

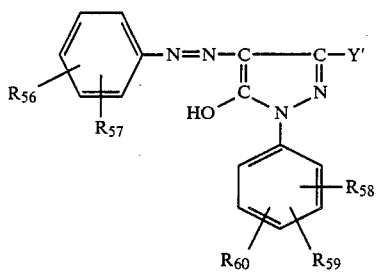

(XVIII)

wherein Y' represents an alkyl group or a carboxyl group; and $R_{56}$, $R_{57}$, $R_{58}$, $R_{59}$ and $R_{60}$, which may be the same or different, each represents a hydrogen atom, an alkyl group, a hydroxyl group, an amino group, an acylamino group, a carboxyl group or a sulfo group.

Formula (XIX) is represented by

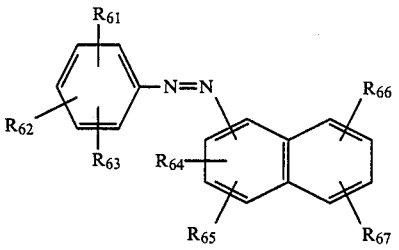

(XIX)

wherein $R_{61}$, $R_{62}$, $R_{63}$, $R_{64}$, $R_{65}$, $R_{66}$ and $R_{67}$, which may be the same or different, each represents a hydrogen atom, an alkyl group, a hydroxyl group, an amino group, an acylamino group, a carboxyl group or a sulfo group, or $R_{62}$ and $R_{63}$ are taken together to form a benzene ring.

Among the dyes represented by formulae (XIV) to (XIX), preferred are acid dyes having an acid radical, e.g., a sulfo group, a carboxyl group, etc., in the molecule. Specific examples of the acid dyes are shown below.

1.

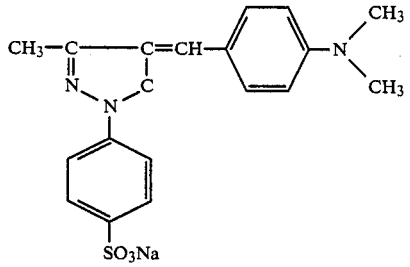

2.

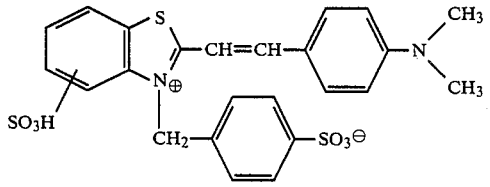

-continued

3.

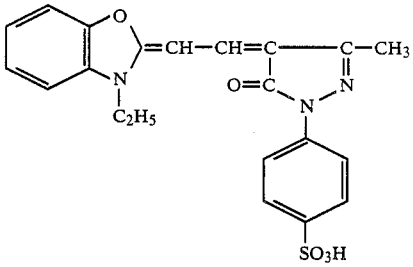

4.

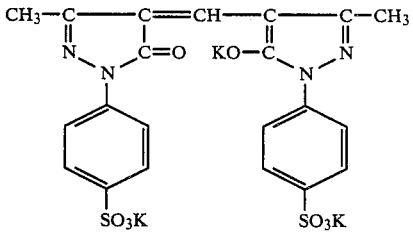

5.

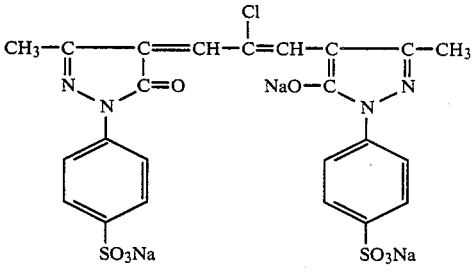

6.

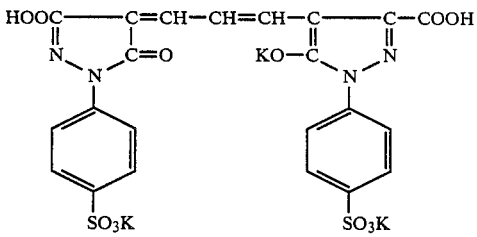

7.

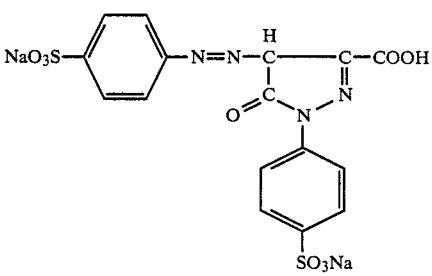

8.

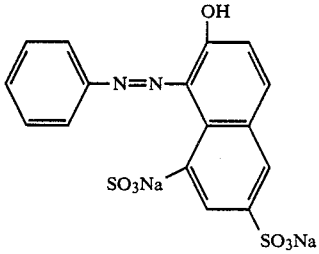

These dyes can be used as a combination of two or more of them.

The dyes of the present invention are used in an amount necessary for the possibility of the treatment in a bright room of the photographic materials.

The amount of the dye to be used can be found within the range of, in general, from $10^{-3}$ g/m$^2$ to 1 g/m$^2$, especially from $10^{-3}$ g/m$^2$ to 0.5 g/m$^2$.

The silver halide emulsion for use in the present invention may comprise any composition of silver chloride, silver chlorobromide, silver iodobromide, silver iodochlorobromide or the like and, in particular, a silver halide composition comprising 60 mol% or more, especially 75 mol% or more, of silver chloride is preferred. More particularly, silver chlorobromide or silver chloroiodobromide containing up to 5 mol% of silver bromide is especially preferred.

The silver halide for use in the present invention preferably comprises fine grains, for example, having a mean grain size of 0.7 μm or less, especially 0.5 μm or less. The grain size distribution is not basically limitative, but the emulsion is preferably a monodispersed one. The monodispersed emulsion herein used means that at least 95% of the grains by weight or by number in the emulsion have a size falling within the range of the mean grain size ±40%.

The silver halide grains in the photographic emulsion may have a regular crystal form such as cubic or octahedral, or an irregulr crystal form such as spherical or tabular, or further a composite form of these crystal forms.

The silver halide grains may comprise the same inner part and surface layer phases or different inner part phase and surface layer phase. Also, two or more silver halide emulsions which were prepared separately can be blended for use in the present invention.

The silver halide grains for use in the present invention may also be formed or physically ripened in the presence of a cadmium salt, a sulfite, a lead salt, a thallium salt, a rhodium salt or a complex salt thereof, an iridium salt or a complex salt thereof, etc.

Preferably, the silver halide grain emulsion of the present invention contains the rhodium salt or complex salt thereof.

As the thodium salt (including complex salt thereof) there may, for example, be mentioned rhodium monochloride, rhodium dichloride, rhodium trichlororide, ammonium hexachlororhodate, etc., and preferably a water-soluble halogeno complex of trivalent rhodium, such as hexachlororhodate (III) or a salt thereof (e.g., ammonium salt, sodium salt, potassium salt, etc.).

The amount of the rhodium salt or complex salt thereof to be added is up to $3.0\times10^{-4}$ mol, preferably within the range of from $1.0\times10^{-7}$ mol to $2.0\times10^{-4}$ mol, per mol of silver halide.

As the binder or protective colloid for the photographic emulsion of the present invention there is advantageously used a gelatin, and other hydrophilic colloids can of course be used. For instance, cellulose derivatives such as carboxymethyl cellulose, etc.; saccharide derivatives such as dextran, starch derivatives, etc.; and other various kinds of synthetic hydrophilic polymer substances such as homo- or copolymers, for example, polyvinyl alcohol, polyvinyl alcohol partial acetal, poly-N-vinylpyrrolidone, polyacrylic acid, polyacrylamide, etc., can be used.

As the gelatin there can be used a lime-processed gelatin and an acid-processed gelatin.

The silver halide emulsion for use in the present invention may or may not be chemically sensitized. For the chemical sensitization of the silver halide emulsion there are known various methods of sulfur sensitization, reduction sensitization and noble metal sensitization, and the emulsion may be chemically sensitized by any of the methods singly or by combination of any of the methods.

As the noble metal sensitization method, a gold sensitization is typical, using a gold compound, mainly a gold complex. Compounds of noble metals other than gold, such as complexes of platinum, palladium, iridium, etc., can of course be used together without any problem.

As the sulfur sensitizer there can be used, for example, sulfur compounds contained in gelatin as well as various sulfur compounds such as thiosulfates, thioureas, thiazoles, rhodanines, etc.

As the reducing sensitizer there can be used, for example, stannous salts, amines, formamidinesulfinic acids, silane compounds, etc.

The photographic materials of the present invention can contain various compounds for the purpose of inhibiting fog during the manufacture step of the materials, storage thereof and photographic processing thereof, or of stabilizing the photographic property of the materials. For instance, various compounds which are known as an antifoggant or stabilizer can be added to the photographic materials of the present invention, including azoles, such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds such as oxazolinethiones; azaindenes, such as triazaindenes, tetraazaindenes (especially 4-hydroxy-substituted (1,3,3a,7)tetraazaindenes), pentaazaindenes, etc.; benzenethiosulfonic acids, benzenesulfinic acids, benzenesulfonic acid amides, etc. Among these compounds, preferable are benzotriazoles (e.g., 5-methylbenzotriazole) and nitroindazoles (e.g., 5-nitroindazole). These compounds can be incorporated in the processing solutions for the materials of the present invention.

The photographic materials of the present invention may also contain an inorganic or organic hardener in the photographic emulsion layer or other hydrophilic colloid layer. For instance, chromium salts, aldehydes (e.g., formaldehyde, glutaraldehyde, etc.), N-methylol compounds, active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids, epoxy compounds, etc., can be used singly or in combination, as the hardener.

Further, the photographic materials of the present invention may also contain various surfactants in the photographic emulsion layer or other hydrophilic colloid layer for the purpose of coating assistance, impartation of antistatic property, improvement of sliding property, emulsification and dispersion, prevention of adhesion, and improvement of photographic characteristics (including acceleration of developability, elevation of contrast and intensification of sensitization), etc.

For instance, nonionic surfactants, such as saponins (e.g., steroid type saponins), alkylene oxide derivatives (e.g., polyethylene glycol, polyethylene glycol/polypropylene glycol condensation product, polyethylene glycol alkyl ethers, polyethylene glycol alkylaryl ethers, polyethylene glycol esters, polyethylene glycol sorbitan esters, polyalkylene glycol alkylamines or amides, silicone-polyethylene oxide adducts), glycidol derivatives (e.g., alkenylsuccinic acid polyglyceride, alkylphenol polyglyceride), esters of polyhydric alcohols and fatty acids, alkyl esters of saccharides, etc.; anionic surfactants containing an acid group such as a carboxyl group, a sulfo group, a phospho group, a sulfate group or a phosphate group, for example, alkylcarboxylic acid salts, alkylsulfonic acid salts, alkylbenzenesulfonic acid salts, alkylnaphthalenesulfonic acid salts, alkyl sulfates, alkyl phosphates, N-acyl-N-alkyltaurines, sulfosuccinates, sulfoalkyl polyoxyethylene alkylphenyl ethers, polyoxyethylene alkyl phosphates, etc.; ampholytic surfactants such as amino acids, aminoalkylsulfonic acids, aminoalkyl sulfates or phosphates, alkylbetaines, amine oxides, etc.; and cationic surfactants such as alkylamine salts, aliphatic or aromatic quaternary ammonium salts, heterocyclic quaternary ammonium salts (e.g., pyridinium or imidazolium salts), aliphatic or heterocyclic phosphonium or sulfonium salts, etc., can be used.

The polyalkylene oxides having a molecular weight of 600 or more, described in Japanese Patent Publication No. 9412/83, are especially preferably used as the surfactant in the present invention. In addition, a polymer latex such as a polyalkyl acrylate can be incorporated into the photographic material of the present invention so as to ensure the dimensional stability.

In order to attain the superhigh contrast photograhic characteristic of the silver halide photographic material of the present invention, it is unnecessary to use a conventional infectious developer or the high alkali developer having a pH value of near 13, such as is described in U.S. Pat. No. 2,419,975, but a stable developer can be used.

For instance, the silver halide photographic material of the present invention can satisfactorily be developed with a developer containing a sulfite ion, as a preservative, in an amount of 0.15 mol/liter or more and having a pH value of from 10.5 to 12.3, especially from 11.0 to 12.0, whereby a sufficiently superhigh contrast negative image can be obtained.

The developing agent for use in the development of the photographic material of the present invention is not specifically limitative, but any of dihydroxybenzenes (e.g., hydroquinone, 3-pyrazolidones (e.g., 1-phenyl-3-pyrazolidone, 4,4-dimethyl-1-phenyl-3-pyrazolidone), aminophenols (e.g., N-methyl-p-aminophenol), etc., can be used singly or in combination.

The silver halide photographic materials of the present invention are especially preferably developed with a developer containing a dihydroxybenzene compound as a developing agent and a 3-pyrazolidone or aminophenol compound as an auxiliary developing agent. Advantageously, the developer contains the dihydroxybenzene compound in an amount of from 0.05 to 0.5 mol/liter and the 3-pyrazolidone or aminophenol compound in an amount of 0.06 mol/liter or less.

Further, an amine compound can be added to the developer, as described in U.S. Pat. No. 4,269,929, so as to accelerate the development speed and to realize a shortening of the development time.

Further, the developer may also contain, in addition to the above-mentioned components, a pH buffer such as an alkali metal sulfite, carbonate, borate or phosphate, as well as a development inhibitor or antifoggant such as a bromide, an iodide, an organic antifoggant (especially preferably nitroindazoles or benzotriazoles), etc. Moreover, the developer may further contain, if desired, a hard water softener, a dissolution aid, a toning agent, a development accelerator, a surfactant (especially preferably the above-mentioned polyalkylene oxides), a defoaming agent, a hardener, a film silver stain inhibitor (such as 2-mercaptobenzimidazolesulfonic acids, etc.), etc.

As the fixing solution, any one having a conventional composition can be used. As the fixing agent there can be used thiosulfates and thiocyanates as well as other organic sulfur compounds which are known to have an effect as a fixing agent. The fixing solution can contain a water-soluble aluminum salt or the like as a hardener.

The processing temperature for the photographic materials of the present invention can be selected, in general, from range of from 18° C. to 50° C.

For the photographic processing of the materials of the present invention, an automatic developing machine is preferably used. The total processing time from the introduction of the photographic material of the present invention into the automatic developing machine to the taking out of the material processed therefrom can be set to fall within the range of from 90 seconds to 120 seconds, whereby an excellent photographic characteristic with a sufficiently superhigh contrast negative gradation can be obtained.

The developer for use in the processing of the material of the present invention can contain the compound described in Japanese patent application (OPI) No. 24347/81 as a silver stain inhibitor. As a dissolution aid to be added to the developer there can be used the compound described in Japanese patent application (OPI) No. 267759/86. Further, the compound described in Japanese patent application (OPI) No. 93433/85 or the compound described in Japanese patent application (OPI) No. 28708/86 can be incorporated into the developer as a pH buffer.

Supports which can be used in the present invention include cellulose acetate film, polyethylene terephthalate film, polystyrene film, polyethylene film or synthetic films thereof.

The following examples are intended to illustrate the present invention but not to limit it in any way.

EXAMPLE 1

An aqueous silver nitrate solution and an aqueous sodium chloride solution were blended in an aqueous gelatin solution kept at 40° C. in the presence of $5\times10^{-6}$ mol, per mol of silver, of $(NH_4)_3RhCl_6$, to obtain silver chloride grains. After the soluble salts were removed in a conventional manner which was well known in this technical field, a gelatin was added and, without chemical ripening, 2-methyl-4-hydroxy-1,3,3a,7-tetraazaindene was added as a stabilizer. The thus-obtained emulsion was a monodispersed emulsion comprising cubic crystal grains with a mean grain size of 0.2 μm.

To the emulsion were added 70 mg/m$^2$ of Hydrazine Derivative (X-31) and 15 mg/m$^2$ of Organic Desensitizer (XI-8), followed by addition of a polyethyl acrylate latex in a solid amount of 30% by weight to the gelatin and 1,3-vinylsulfonyl-2-propanol as a hardener This was coated on a polyester support in an amount of 3.8 g as Ag per m$^2$. The gelatin content in the emulsion was 1.8 g/m$^2$, and a gelatin layer of 1.0 g/m$^2$ was superimposed on the emulsion layer as a protective layer. The thus-obtained sample was designated Sample No. (1-a).

Using the same emulsion as Sample (1-a), other Sample Nos. (1-b) through (1-h) were formed in the same manner, provided that the nucleation accelerator (contrast enhancer) of formula (I) as shown in Table 1 below was added to each sample.

Each of these samples was exposed with a bright room-type printer P-607 (manufactured by Dainippon Screen Mfg. Co., Ltd.) through an optical wedge, and then developed with the following developer for 30 seconds at 38° C., fixed, rinsed and dried. The photographic results obtained are shown in Table 1 below.

Sample No. (1-h) is the same as Sample No. (1-a), except that the former contains no organic desensitizer.

Developer

| | |
|---|---|
| Hydroquinone | 45.0 g |
| N—Methyl-p-aminophenol (½ sulfate) | 0.8 g |
| Sodium Hydroxide | 18.0 g |
| Potassium Hydroxide | 55.0 g |
| 5-Sulfosalicylic Acid | 45.0 g |
| Boric Acid | 25.0 g |
| Potassium Sulfite | 110.0 g |
| Disodium Ethylenediaminetetraacetate | 1.0 g |
| Potassium Bromide | 6.0 g |
| 5-Methylbenzotriazole | 0.6 g |
| N—Butyldiethanolamine | 15.0 g |
| Water to make | 1 liter<br>pH: 11.6 |

TABLE 1

| Sample No. | Compound of Formula (I) Kind | Compound of Formula (I) Amount Added (mg/m²) | Photographic Property Sensitivity ΔlogE | Photographic Property γ | Remarks |
|---|---|---|---|---|---|
| (1-a) | — | — | Type | 7.5 | Comparison |
| (1-b) | (1) | 50 | +0.15 | 15 | Invention |
| (1-c) | (6) | 50 | +0.15 | 15 | " |
| (1-d) | (9) | 50 | +0.15 | 18 | " |
| (1-e) | (13) | 50 | +0.15 | 18 | " |
| (1-f) | (15) | 50 | +0.1 | 25 | " |
| (1-g) | (16) | 50 | +0.1 | 25 | " |
| (1-h) | — | — | +1.0 | 20 | Comparison, No desensitizer |

Sample No. (1-a), as containing the organic desensitizer, has a remarkably decreased sensitivity, as compared with Sample No. (1-h), with the decrease of γ to cause the lowering of the contrast. It is noted from the results in Table 1 above that the use of the compound of the invention is effective for lowering the sensitivity without decreasing the contrast.

The γ value was defined as follows:

$$\gamma = \frac{3.0 - 0.3}{\text{Difference in the Sensitivity Point between Density 3.0 and Density 0.3}}$$

EXAMPLE 2

In the same manner as the preparation of Sample No. (1-f) in Example 1, other samples were prepared, except that the hydrazine derivative (nucleating agent) was varied as shown in Table 2 below. In the same manner as in Example 1, the sensitivity and γ value were evaluated on the samples obtained. The results of Table 2 prove that the combinations of the invention are superior to the comparative combination in that the γ value is high with no remarkable elevation of the sensitivity in the samples of the invention.

TABLE 2

| Sample No. | Compound of Formula (I) | Hydrazine Derivative Kind | Hydrazine Derivative Amount Added (mg/m²) | Photographic Property Sensitivity Δlog E | Photographic Property γ | Remarks |
|---|---|---|---|---|---|---|
| (2-a) | (15) | (X-9) | 70 | +0.12 | 15 | Invention |
| (2-b) | " | (X-18) | " | +0.15 | 22 | " |
| (2-c) | " | (X-24) | " | +0.15 | 16 | " |
| (2-d) (same as (1-f)) | " | (X-31) | " | +0.1 | 24 | " |
| (2-e) | " | (X-32) | 20 | +0.1 | 15 | " |
| (2-f) | " | Combination of (X-31) and (X-32) | 20 (X-31)<br>10 (X-32) | +0.05 | 22 | " |
| (1-a) | — | (X-31) | 70 | Type | 7.5 | Comparison |

EXAMPLE 3

In the same manner as the preparation of Sample No. (2-d) in Example 2, other samples were prepared, except that the organic desensitizer was varied as shown in Table 3 below. In the same manner as in Example 2, the sensitivity and γ value were evaluated on the samples obtained. The results of Table 3 prove that the combinations of the invention are superior to the comparative combination in that the γ value is high with no remarkable elevation of the sensitivity in the samples of the invention.

TABLE 3

| Sample No. | Compound of Formula (I) | Hydrazine Derivative | Organic Desensitizer Kind | Organic Desensitizer Amount Added (mg/m²) | Photographic Property Sensitivity ΔlogE | Photographic Property γ | Remarks |
|---|---|---|---|---|---|---|---|
| (3-a) | (15) | (X-31) | (XI-1) | 16 | +0.2 | 18 | Invention |
| (3-b) | " | " | (XI-2) | 18 | +0.3 | 15 | " |

TABLE 3-continued

| Sample No. | Compound of Formula (I) | Hydrazine Derivative | Organic Desensitizer Kind | Organic Desensitizer Amount Added (mg/m²) | Photographic Property Sensitivity ΔlogE | Photographic Property γ | Remarks |
|---|---|---|---|---|---|---|---|
| (3-c) | " | " | (XI-4) | 15 | +0.1 | 22 | " |
| (3-d) | " | " | (XI-7) | 16 | +0.1 | 22 | " |
| (3-e) (same as (2-d)) | " | " | (XI-8) | 15 | +0.1 | 25 | " |
| (3-f) | " | " | (XI-9) | 17 | +0.1 | 20 | " |
| (1-a) | — | (X-31) | (XI-8) | 15 | Type | 7.5 | Comparison |

EXAMPLE 4

An aqueous silver nitrate solution and an aqueous sodium chloride solution were blended in an aqueous gelatin solution kept at 40° C. in the presence of $5.0\times10^{-6}$ mol, per mol of silver, of $(NH_4)_3RhCl_6$, to obtain silver chloride grains. After the soluble salts were removed in a conventional manner which was well known in this technical field, a gelatin was added and, without chemical ripening, 2-methyl-4-hydroxy-1,3,3a,7-tetraazaindene was added as a stabilizer. The thus-obtained emulsion was a monodispersed emulsion comprising cubic grains with a mean grain size of 0.2 μm.

To the emulsion was added 70 mg/m² of Hydrazine Derivative (X-31) (nucleating agent), followed by addition of a polyethyl acrylate latex in a solid amount of 30% by weight to the gelatin and 1,3-vinylsulfonyl-2-propanol as a hardener. This was coated on a polyester support in an amount of 3.8 g as Ag per m². The gelatin content in the emulsion was 1.8 g/m², and a gelatin layer of 1.0 g/m² was superimposed on the emulsion layer as a protective layer. The thus-obtained sample was designated Sample No. (4-a).

In the same manner as the preparation of Sample No. (4-a), other samples were prepared, except that the amount of the ammonium rhodium chloride was varied as shown in Table 4 below and further the compound of formula (I) was also varied as shown therein. In the same manner as the operation of Example 1, the sensitivity and γ value were evaluated on the samples obtained. The results of Table 4 prove that the addition of the compound of formula (I) of the invention is effective for intensification of the contrast with no remarkable elevation of the sensitivity and additionally is effective for preventing the decrease of the contrast which would result from the increase of the amount of the rhodium salt added.

TABLE 4

| Sample No. | $(NH_4)_3RhCl_6$ (mol/mol Ag) | Nucleating Agent | Compound of Formula (I) Kind | Compound of Formula (I) Amount Added (mg/m²) | Photographic Property Sensitivity | Photographic Property γ | Remarks |
|---|---|---|---|---|---|---|---|
| (4-a) | $5\times10^{-6}$ | (X-31) | — | — | Type | 20 | Comparison |
| (4-b) | " | " | (1) | 50 | +0.15 | 25 | Invention |
| (4-c) | " | " | (6) | 50 | +0.15 | 25 | " |
| (4-d) | " | " | (13) | 50 | +0.15 | 25 | " |
| (4-e) | " | " | (15) | 50 | +0.1 | 35 | " |
| (4-f) | " | " | (16) | 50 | +0.1 | 35 | " |
| (4-a') | $2.5\times10^{-5}$ | (X-31) | — | — | −0.7 | 10 | Comparison |
| (4-b') | " | " | (1) | 50 | −0.55 | 20 | Invention |
| (4-c') | " | " | (6) | 50 | −0.55 | 20 | " |
| (4-d') | " | " | (13) | 50 | −0.55 | 20 | " |
| (4-e') | " | " | (15) | 50 | −0.6 | 30 | " |
| (4-f') | " | " | (16) | 50 | −0.6 | 30 | " |
| (4-a'') | $5\times10^{-5}$ | (X-31) | — | — | −1.0 | 5 | Comparison |
| (4-b'') | " | " | (1) | 50 | −0.85 | 13 | Invention |
| (4-c'') | " | " | (6) | 50 | −0.85 | 15 | " |
| (4-d'') | " | " | (13) | 50 | −0.85 | 15 | " |
| (4-e'') | " | " | (15) | 50 | −0.9 | 25 | " |
| (4-f'') | " | " | (16) | 50 | −0.9 | 25 | " |
| (4-a''') | 0 | (X-31) | — | — | +1.0 | 25 | Comparison |
| (4-b''') | " | " | (1) | 50 | +1.2 | 35 | Invention |
| (4-c''') | " | " | (6) | 50 | +1.2 | 35 | " |
| (4-d''') | " | " | (13) | 50 | +1.2 | 35 | " |
| (4-e''') | " | " | (15) | 50 | +1.1 | 35 or more | " |
| (4-f''') | " | " | (16) | 50 | +1.1 | 35 or more | " |

EXAMPLE 5

In the same manner as in Example 1, the samples of Table 5 below were prepared, except that the mean grain size of the emulsion grains was adjusted to 0.08 μm and that the amount of the rhodium salt added was varied as shown in Table 5. The samples thus-obtained were evaluated in the same manner as in Example 1.

TABLE 5

| Sample No. | Rhodium Salt (mol/mol Ag) | Compound of Formula (I) Kind | Compound of Formula (I) Amount Added ($mg/m^2$) | Photographic Property Sensitivity ΔlogE | Photographic Property γ | Remarks |
|---|---|---|---|---|---|---|
| (1-a) | $5 \times 10^{-6}$ | — | — | Type | 7.5 | Comparison |
| (5-a) | " | — | — | −0.4 | 12 | " |
| (5-b) | " | (1) | 50 | −0.25 | 20 | Invention |
| (5-c) | " | (6) | " | −0.25 | 20 | " |
| (5-d) | " | (13) | " | −0.25 | 20 | " |
| (5-e) | " | (15) | " | −0.3 | 34 | " |
| (5-f) | " | (16) | " | −0.3 | 33 | " |
| (1-a') | $5 \times 10^{-5}$ | — | — | −0.1 | 2.0 | Comparison |
| (5-a') | " | — | — | −0.5 | 3.0 | " |
| (5-b') | " | (1) | 50 | −0.30 | 10 | Invention |
| (5-c') | " | (6) | " | −0.30 | 12 | " |
| (5-d') | " | (13) | " | −0.30 | 12 | " |
| (5-e') | " | (15) | " | −0.4 | 20 | " |
| (5-f') | " | (16) | " | −0.4 | 18 | " |

In Table 5 above, Sample No. (1-a') is the same as Sample No. (1-a) except that only the amount of the rhodium salt in the emulsion was varied.

The results of Table 5 prove that the nucleation accelerator represented by formula (I) of the invention is effective even when added to fine grain emulsions and that this is also effective even when used together with a large amount of the rhodium salt.

While the invention has been described in detail and with reference to specific embodiments thereof, it will be apparent to one skilled in the art that various changes and modifications can be made therein without departing from the spirit and scope thereof.

What is claimed is:

1. A superhigh contrast negative type silver halide photographic material which comprises a support having provided thereon at least one silver halide emulsion layer, said emulsion layer or at least one other hydrophilic colloid layer containing at least one hydrazine derivative and at least one compound of formula (II) which has a high contrast promoting property:

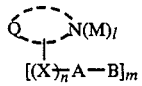

(II)

wherein X represents a divalent linking group comprising an atom or atoms selected from a hydrogen atom, a carbon atom, a nitrogen atom, an oxygen atom and a sulfur atom or an atomic group comprised of said atoms; A represents a divalent linking group; B represents a substituted or unsubstituted amino group, an ammonium group or a nitrogen-containing heterocyclic group; m represents 1, 2 or 3; n represents 0 or 1, wherein l represents 0 or 1; Q represents an atomic group necessary for forming a 5- or 6-membered hetero ring which comprises at least one atom selected from a carbon atom, a nitrogen atom, an oxygen atom and a sulfur atom, the hetero ring being optionally condensed with a carbon-aromatic ring or a hetero aromatic ring; and M represents a hydrogen atom, an alkali metal atom, an ammonium group or a group capable of being converted into H or an alkali metal under an alkali condition, wherein in formula (II), Q does not form

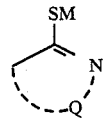

and B does not include a group of the formula —NHNHCHO.

2. A superhigh contrast negative type silver halide photographic material as in claim 1, wherein said compound of formula (II) is selected from the compounds of formulae (III) through (VI):

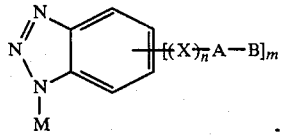

(III)

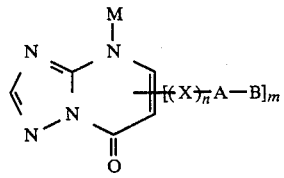

(IV)

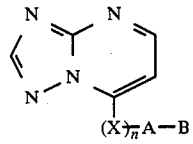

(V)

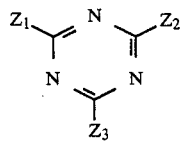

(VI)

wherein X, A, B, M, m and n have the same meaning as in formula (II); and $Z_1$, $Z_2$ and $Z_3$ have the same meaning as $X_nA$-B in formula (II), or these independently represent a halogen atom, an alkoxy group having 20 or less carbon atoms, a hydroxyl group, a hydroxyamino group or a substituted or unsubstituted amino group, provided that at least one of these $Z_1$, $Z_2$ and $Z_3$ must have the same meaning as $X_nA$-B.

3. A superhigh contrast negative type silver halide photographic material as in claim 1, which further contains an organic desensitizer having a water-soluble group or an alkali dissociating group.

4. A superhigh contrast negative type silver halide photographic material as in claim 3, wherein the organic desensitizer is selected from the compounds of formulae (XI) through (XIII):

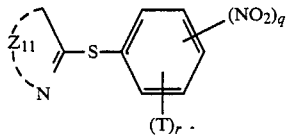
(XI)

wherein $Z_{11}$ represents a group of nonmetal atoms required to complete a nitrogen-containing heterocyclic ring; T represents an alkyl group, a cycloalkyl group, an alkenyl group, a halogen atom, a cyano group, a trifluoromethyl group, an alkoxy group, an aryloxy group, a hydroxyl group, an alkoxycarbonyl group, a carboxyl group, a carbamoyl group, a sulfamoyl group, an aryl group, an acylamino group, a sulfonamido group, a sulfo group or a benzo-condensed ring, which may further have at least one substituent; q is 1, 2 or 3; and r is 0, 1 or 2;

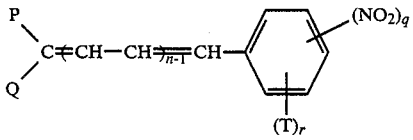
(XII)

wherein P and Q, which may be the same or different, each represents a cyano group, an acyl group, a thioacyl group, an alkoxycarbonyl group, an alkylsulfonyl group, an arylsulfonyl group, a substituted or unsubstituted sulfamoyl group, a substituted or unsubstituted carbamoyl group, a nitro group, or a substituted or unsubstituted aryl group; n is 1, 2 or 3; and T, r and q have the same meaning as in formula (XI);

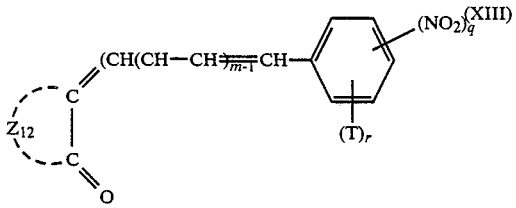
(XIII)

wherein $Z_{12}$ represents a group of nonmetal atoms required to complete a ketomethylene ring; m is 1, 2 or 3; and T, r and q have the same meaning as in formula (XI); provided that substituents $Z_{11}$, $Z_{12}$, T, P and Q in formulae (XI) to (XIII) have at least one water-soluble group or alkali dissociating group.

5. A superhigh contrast negative type silver halide photographic material as in claim 1, which further contains a dye or an ultraviolet absorbent.

6. A superhigh contrast negative type silver halide photographic material as in claim 5, wherein the dye is selected from the compounds of general formulae (XIV) through (XIX):

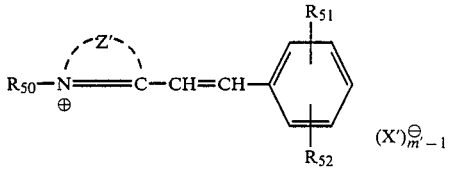
(XIV)

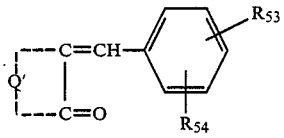
(XV)

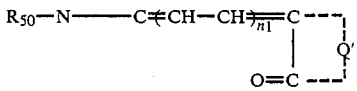
(XVI)

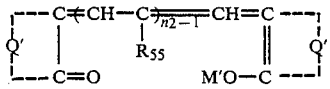
(XVII)

wherein Z' represents a nonmetal atomic group necessary for forming a benzothiazole ring, a naphthothiazole ring or a benzoxazole ring; Q' represents an atomic group necessary for forming a pyrazolone ring, a barbituric acid ring, a thiobarbituric acid ring, an isoxazolone ring, a 3-oxythionaphthene ring or a 1,3-indanedione ring; $R_{50}$ represents a substituted or unsubstituted alkyl group; $R_{51}$, $R_{52}$, $R_{53}$ and $R_{54}$ each represents a hydrogen atom, an alkoxy group, a dialkylamino group or a sulfo group; $R_{55}$ represents a hydrogen atom or a halogen atom; M' represents a hydrogen atom, a sodium atom or a potassium atom; X' represents an anion; m', $n_1$ and $n_2$ each represents 1 or 2; provided that when m is 1, the compound is in the form of an inner salt;

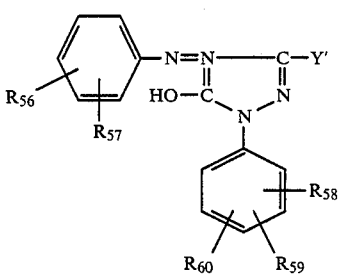
(XVIII)

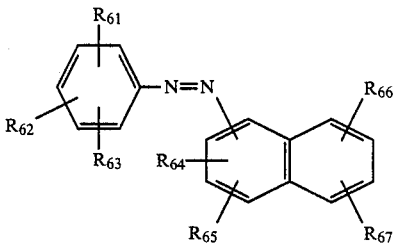
(XIX)

wherein Y' represents an alkyl group or a carboxyl group; $R_{56}$, $R_{57}$, $R_{58}$, $R_{59}$, $R_{60}$, $R_{61}$, $R_{62}$, $R_{63}$, $R_{64}$, $R_{65}$, $R_{66}$ and $R_{67}$ each represents a hydrogen atom, an alkyl group, a hydroxyl group, an amino group, an acylamino group, a carboxyl group or a sulfo group; provided that $R_{62}$ and $R_{63}$ may be bonded together to form a benzene ring.

7. A superhigh contrast negative type silver halide photographic material as in claim 1, wherein the emulsion further contains a rhodium salt or a complex salt thereof.

8. A method for forming an image, wherein the photographic material of claim 1 is processed with a developer containing a sulfite ion in an amount of 0.15 mol/-liter or more and having a pH value ranging from 10.5 to 12.3.

* * * * *